US007832041B2

(12) United States Patent
Smith et al.

(10) Patent No.: US 7,832,041 B2
(45) Date of Patent: Nov. 16, 2010

(54) INSTANT STAIN REMOVING DEVICE, FORMULATION AND ABSORBENT MEANS

(75) Inventors: Leland J. Smith, Midland, MI (US); Michael J. Banco, Racine, WI (US); Douglas A. Soller, Racine, WI (US); Roberta A. Wick, Racine, WI (US); Christopher R. Sheridan, Racine, WI (US); Jeanne A. O'Brien, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 550 days.

(21) Appl. No.: 11/767,268

(22) Filed: Jun. 22, 2007

(65) Prior Publication Data

US 2008/0041425 A1 Feb. 21, 2008

Related U.S. Application Data

(63) Continuation-in-part of application No. 11/564,376, filed on Nov. 29, 2006, now Pat. No. 7,596,974.

(60) Provisional application No. 60/805,159, filed on Jun. 19, 2006.

(51) Int. Cl.
*D06F 39/00* (2006.01)

(52) U.S. Cl. ..... 8/148; 68/213; 401/119

(58) Field of Classification Search ..... 68/214; 410/118–130

See application file for complete search history.

(56) References Cited

U.S. PATENT DOCUMENTS 2,207,296 A * 7/1940 Lee ..... 15/433
2,637,868 A * 5/1953 Hamilton ..... 401/19
2,674,001 A * 4/1954 Abrams et al. ..... 15/184
2,701,378 A * 2/1955 Reinbolt et al. ..... 15/111
2,716,250 A * 8/1955 Deakers ..... 401/186
3,281,887 A * 11/1966 Peter ..... 401/205
4,940,350 A * 7/1990 Kim ..... 401/209
4,998,839 A 3/1991 Bashir
5,122,158 A * 6/1992 Kuroda et al. ..... 8/137
5,244,593 A 9/1993 Roselle et al.
5,504,962 A * 4/1996 Byun ..... 15/184

(Continued)

FOREIGN PATENT DOCUMENTS

DE 350188388 9/1985

(Continued)

OTHER PUBLICATIONS

PCT/US2007/013897 International Search Report and Written Opinion dated May 27, 2008 (J-4694A).

*Primary Examiner*—Frankie L Stinson

(57) ABSTRACT

A device for applying stain treatment formulation to a garment or article of clothing while it is being worn is disclosed. The device includes a reservoir with an applicator tip for containing the formulation and dispensing the formulation to a stain, spot or mark on the garment. The device also includes a shell connected to the reservoir for housing an absorbent member dispensing mechanism. After the stain removal formulation is applied, the absorbent member is pressed and/or rubbed on the stain to lift and remove the stain and to absorb or wick excess formulation thereby reducing the time needed for the resulting wet spot to dry. Effective stain removing formulations for on-the-go use are also provided.

19 Claims, 16 Drawing Sheets

U.S. PATENT DOCUMENTS

| | | | | | |
|---|---|---|---|---|---|
| 5,584,592 | A * | 12/1996 | Craig | 401/31 |
| 5,597,255 | A * | 1/1997 | Yager et al. | 401/207 |
| 5,746,530 | A * | 5/1998 | Oota | 401/88 |
| 5,776,206 | A | 7/1998 | Kleber | |
| 5,840,675 | A | 11/1998 | Yeazell | |
| 5,955,415 | A | 9/1999 | Gutierrez et al. | |
| 5,971,645 | A * | 10/1999 | Fukushima et al. | 401/183 |
| 5,993,097 | A | 11/1999 | DeBaene | |
| 5,993,560 | A * | 11/1999 | Wasak et al. | 134/6 |
| 6,037,317 | A | 3/2000 | Rapisarda et al. | |
| 6,048,368 | A | 4/2000 | Tcheou et al. | |
| 6,074,705 | A | 6/2000 | DeBaene | |
| 6,183,154 | B1 * | 2/2001 | Coe | 401/196 |
| 6,270,277 | B1 * | 8/2001 | Ogino et al. | 401/269 |
| 6,376,444 | B1 | 4/2002 | Hortel et al. | |
| 6,514,924 | B1 | 2/2003 | Van Hauwermeiren et al. | |
| 6,644,879 | B2 | 11/2003 | Irvin et al. | |
| 6,689,730 | B2 | 2/2004 | Senapati et al. | |
| 6,689,736 | B2 | 2/2004 | Thomas et al. | |
| 6,692,173 | B2 | 2/2004 | Gueret | |
| 6,715,326 | B2 * | 4/2004 | Price | 68/213 |
| 6,811,338 | B1 | 11/2004 | Gruenbacher et al. | |
| 6,826,913 | B2 | 12/2004 | Wright | |
| 6,829,913 | B2 * | 12/2004 | Goldoni et al. | 68/5 A |
| 6,832,867 | B2 | 12/2004 | Sandbach et al. | |
| 6,838,423 | B2 | 1/2005 | Irvin et al. | |
| 6,846,332 | B2 | 1/2005 | Boissie et al. | |
| 6,905,276 | B2 | 6/2005 | Van Buskirk et al. | |
| 6,939,839 | B2 | 9/2005 | Johnson | |
| 7,047,582 | B2 | 5/2006 | Moe et al. | |
| 7,125,189 | B2 | 10/2006 | Gueret | |
| 7,144,177 | B2 | 12/2006 | Van Buskirk et al. | |
| 7,653,960 | B2 * | 2/2010 | Lee | 15/184 |
| 2002/0091070 | A1 | 7/2002 | Engisch et al. | |
| 2003/0087781 | A1 | 5/2003 | Van Hauwermeiren et al. | |
| 2003/0145634 | A1 | 8/2003 | Price | |
| 2004/0084063 | A1 | 5/2004 | Vago et al. | |
| 2004/0152616 | A1 | 8/2004 | Murphy et al. | |
| 2004/0231061 | A1 | 11/2004 | Irvin et al. | |
| 2005/0066996 | A1 | 3/2005 | France et al. | |
| 2005/0086761 | A1 | 4/2005 | Shenouda | |
| 2005/0119151 | A1 | 6/2005 | Mayer et al. | |
| 2005/0147455 | A1 | 7/2005 | Muhr-Sweeney | |
| 2005/0164903 | A1 | 7/2005 | Ko et al. | |
| 2005/0197268 | A1 | 9/2005 | Buskirk et al. | |
| 2005/0199265 | A1 | 9/2005 | France et al. | |
| 2005/0251944 | A1 | 11/2005 | Buskirk et al. | |
| 2006/0053567 | A1 | 3/2006 | Sandbach et al. | |
| 2006/0123562 | A1 | 6/2006 | Ghosh et al. | |
| 2006/0137106 | A1 * | 6/2006 | Goodman | 8/148 |
| 2006/0245816 | A1 | 11/2006 | Sharp et al. | |

FOREIGN PATENT DOCUMENTS

| | | |
|---|---|---|
| DE | 19536714 | 6/1999 |
| EP | 0 063 668 | 3/1982 |
| EP | 0 218 371 | 4/1987 |
| EP | 1 714 605 | 10/2006 |
| EP | 1 714 712 | 10/2006 |
| FR | 2561097 | 9/1985 |
| GB | 971691 A | 9/1964 |
| JP | 7100288 | 4/1995 |
| JP | 2001149692 | 6/2001 |
| WO | WO 97/20099 | 6/1997 |
| WO | WO 99/02769 | 1/1999 |
| WO | WO 99/04082 | 1/1999 |
| WO | WO 99/46319 | 9/1999 |
| WO | WO 01/04260 | 1/2001 |
| WO | WO 01/04407 | 1/2001 |
| WO | WO 02/079362 | 10/2002 |
| WO | WO 02/079363 | 10/2002 |
| WO | WO 02/079366 | 10/2002 |
| WO | WO 02/079368 | 10/2002 |
| WO | WO 02/079369 | 10/2002 |
| WO | WO02/079370 A | 10/2002 |
| WO | WO 02/479367 | 10/2002 |
| WO | WO 2006/055713 | 5/2006 |

* cited by examiner

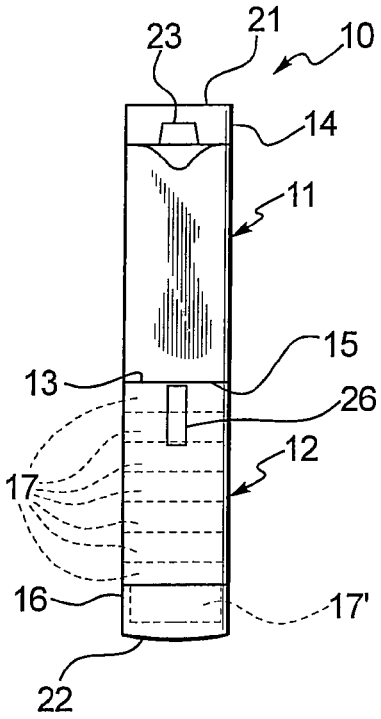
FIG. 1
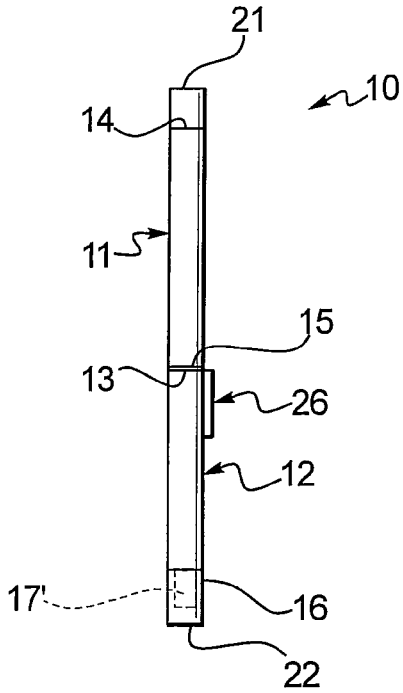
FIG. 2
FIG. 3
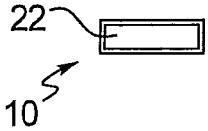
FIG. 4
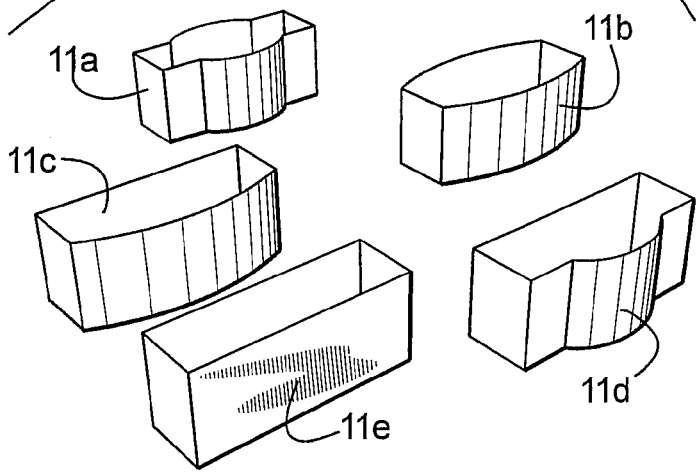

FIG. 25A
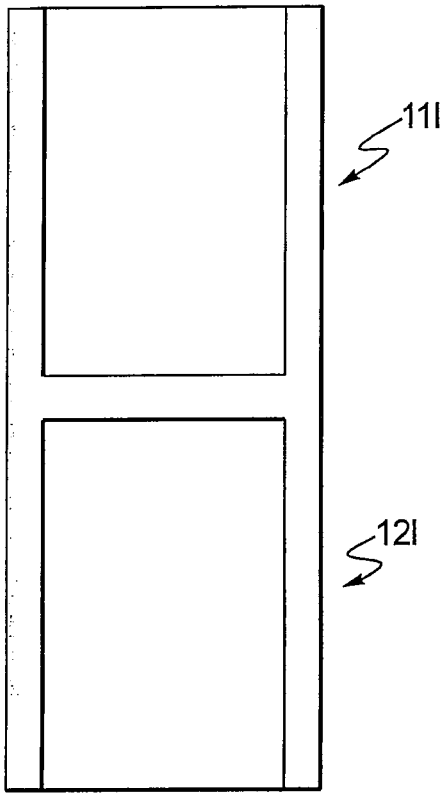
FIG. 25B
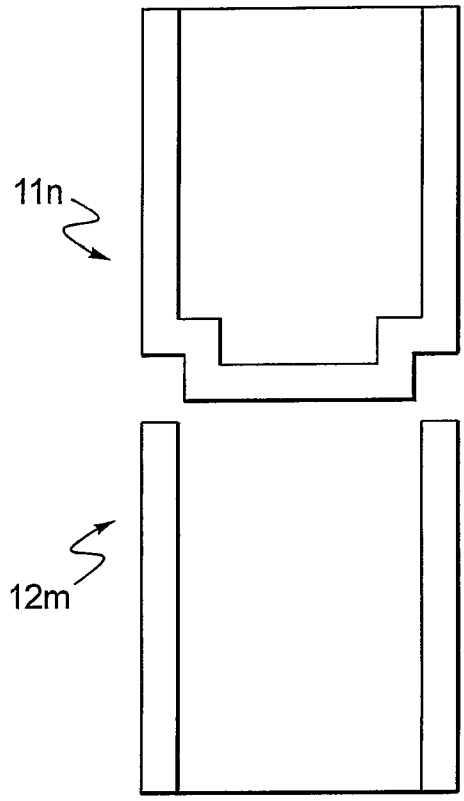
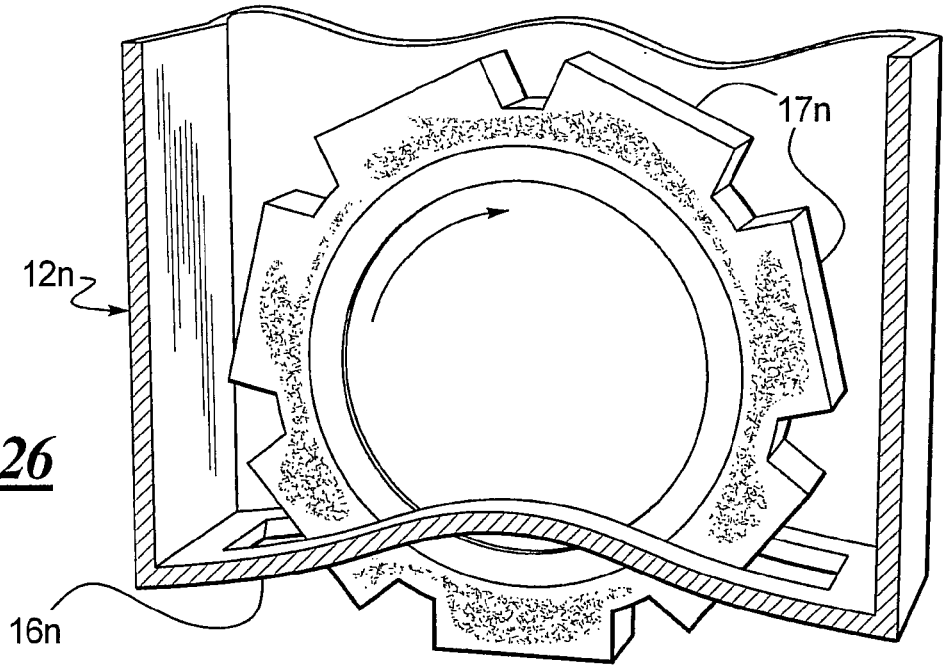
FIG. 26

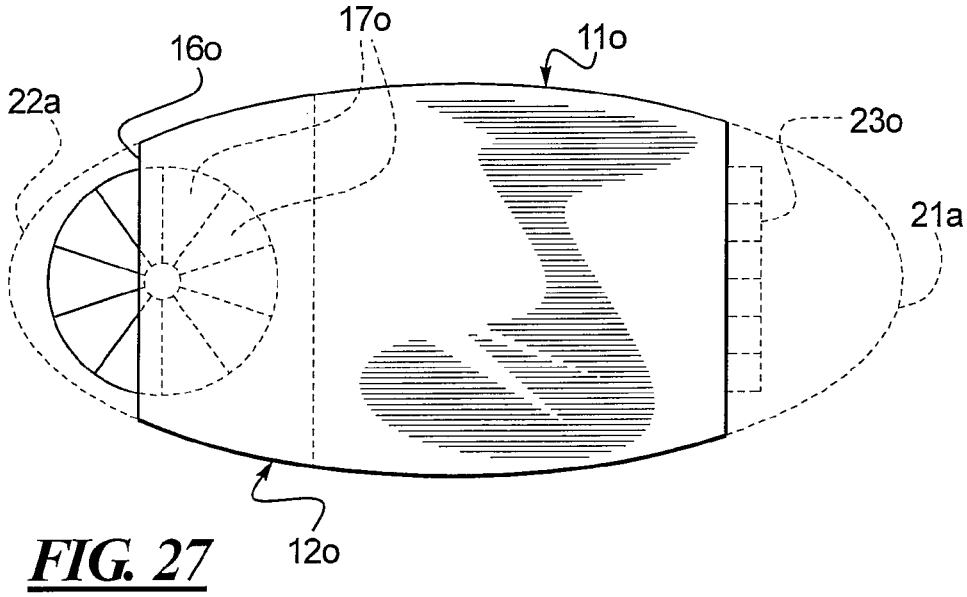
FIG. 27
FIG. 28
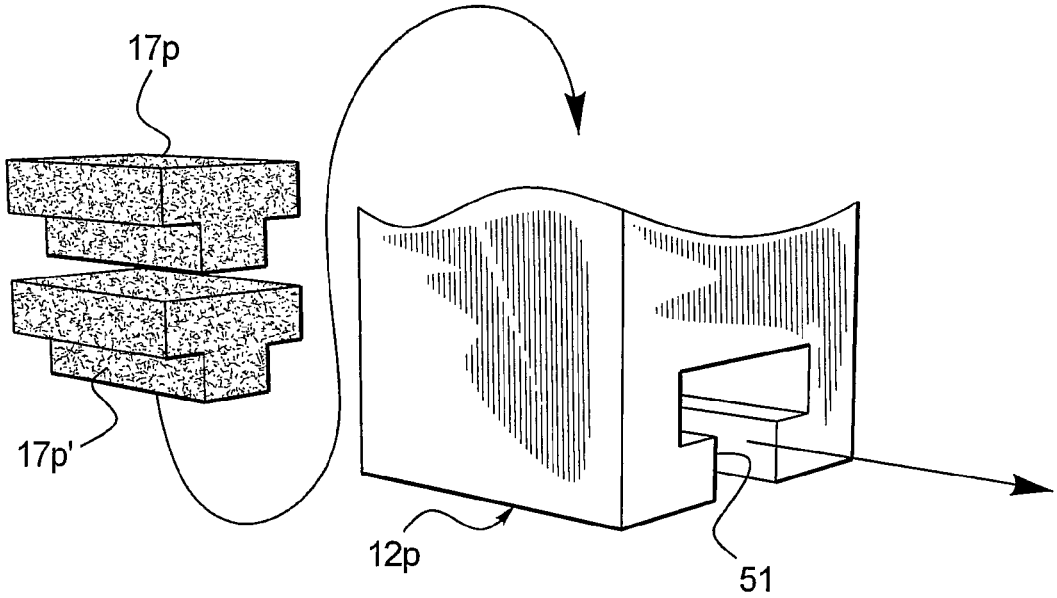

INSTANT STAIN REMOVING DEVICE, FORMULATION AND ABSORBENT MEANS

CROSS-REFERENCE TO RELATED APPLICATION

This application claims priority from U.S. patent application Ser. No. 11,564,376, filed on Nov. 29, 2006, which claims priority from provisional Application Ser. No. 60/805,159, filed on Jun. 19, 2006.

BACKGROUND

1. Technical Field

An instant stain removing device is disclosed for removing a stain from surfaces, such as fabric and clothing. The device includes a reservoir with the applicator tip disposed at one end of the reservoir for containing and dispensing a stain removal formulation. The reservoir is connected to an absorbent pad dispenser. Formulations suitable for removing stains and spots from articles of clothing, and/or rendering such stains and spots invisible or less visible, are also disclosed.

2. Description of the Related Art

It is highly embarrassing to spill dark-colored liquid or food on a light-colored garment or mark the garment with a pen or marker when one is at work or otherwise away from home. Such occurrences are especially embarrassing when it happens early in the day, or when business or social meetings are scheduled before one has time to change clothes. In response to the obvious consumer need for a device and a formulation for treating stains, spills or markings on clothing while the clothing is being worn, instant stain removing pens and other devices have been developed.

One particular device resembles a large felt tip marker in structure but which includes an applicator tip or nib that dispenses a clear stain-removing formulation from a reservoir. While this and other similar products are suitable to be used directly on clothing that is being worn, one problem associated with these products is that the user must walk around with a visible wet spot on his/her clothing that can be just as embarrassing as the original food, drink or ink stain.

Another problem associated with the above-referenced devices is the lack of ability to effectively remove or lift a stain from the fabric. These devices merely function to "dilute" or "spread" the stain as opposed to removing or lifting the stain. While the stain may be lighter than it was before treatment, the stain remains clearly visible and therefore, still embarrassing.

To address the wet residue and stain diluting/spreading issues, efforts have been made to provide an absorbing or drying mechanism to the devices. The improved devices generally include an applicator disposed at one end for applying a stain-removing fluid and an absorbent mechanism disposed at the other end of the device. These devices, however, fail to combine an effective stain removal formulation, an effective and efficient applicator tip and an effective absorbent pad mechanism. For example, while one such device includes discrete absorbent pads that may be used, broken off and discarded after they become discolored, the mechanism for advancing the pads out a pad holder is awkward and non-ergonomic.

Also known in the art are disposable, single-use devices for removing stains. The disposable devices generally include a frangible chamber containing a stain-removing fluid and an absorbent pad coaxially aligned with the chamber. In use, the stain-removing fluid is discharged onto the stains by breaking the frangible chamber. The treated stains and excess fluid may be absorbed by the absorbent pad as the pad is rubbed against the stain. These devices, however, cannot provide delivery of variable amounts of the fluid, or multiple treatment of the stains, as the entirety of the fluid is discharged in one application.

Motorized stain removal brushes are also known in the art. These brushes, however, are bulky to carry around and require batteries. Moreover, the engagement of the motorized brushes with a delicate fabric may cause undesirable damages or wrinkles to the fabric that are as embarrassing as stains. Thus, these devices are not suitable for on-the-going stain removal applications. Similarly, hand-held ultrasonic applicators for treating stains are also not practical for on-the-go stain or spot removal needs because these applicators requirea power source and an ultrasonic source.

Another issue not addressed by the above devices is the treatment of tough stains, such as ink or grease. Ordinary formulations for treating tough stains generally include considerable amounts of oxidant and/or bleach which may not be suitable for use in "on-the-go" stain removal devices because the formulation used in such devices often comes in contact with a consumer's skin as well as delicate fabrics without instant rinsing. Therefore, halogens and higher concentrations of peroxides need to be avoided because of their ability to irritate human skin or damage or discolor delicate fabrics. Moreover, the combination of hydrogen peroxide and sunlight, which may result in permanent discoloration (yellowing) of fabrics, also needs to be avoided.

Hence, there is a need for a stain-removing device that provides an effective formulation for removing common everyday stains from articles of clothing. Further, there is a need for an improved stain-removing device that reduces the dry time of the formulation so that the user does not have to wear clothing with a visible wet spot thereon for a prolonged period of time. Still further, there is a need for an improved stain-removing device that lifts and removes the treated stain from the treated fabric.

SUMMARY OF THE DISCLOSURE

In satisfaction of the aforenoted needs, an improved device for removing a stain from a surface, such as fabric or clothing, is disclosed. The disclosed device comprises a fluid reservoir with an applicator tip for containing and dispensing a stain treatment formulation. The device also includes a shell connected to the reservoir for housing an absorbent member. Preferably, the absorbent member comprises a plurality of stacked absorbent pads that are detachably linked together so that when a pad that has been used becomes soiled or discolored, it can be easily broken off from the stack thereby exposing a clean pad that is ready for further applications.

The applicator tip preferably includes one or more restrictive flow tubes, conduits or channels that provide fluid communication between the fluid reservoir and a distal outer surface of the applicator tip. In a refinement, the number of restrictive flow conduits ranges from one to about five. In embodiments with a plurality of restrictive flow conduits, the conduits are preferably arranged in a parallel configuration.

In a related refinement, the internal diameter of the restrictive flow conduit(s) ranges from about 0.010 to about 0.060 inches. In another related refinement, the length of the conduit(s) or the length of the "land" ranges from about 0.020 to about 0.25 inches. In yet another refinement, the one or more restrictive flow conduits have a non-uniform or stepped internal diameter.

As an alternative to the restrictive flow conduit discussed above, a valve may be disposed within the applicator tip to control the flow of the stain treatment formulation. Such valves may include, but are not limited to, check valves, duckbill valves, flapper valves, cross-slot diaphragm valves, etc. Further, the applicator tip may include a porous plastic material or porous foam.

In a refinement, the restrictive flow-type applicator tip is replaced by a nib in combination with a cross-slot diaphragm valve or other suitable valve mechanisms. The valve is normally in a closed position and is opened when squeezing pressure is applied to the reservoir. In an open position, the stain treatment formulation flows through the nib channel and on to the fabric. Preferably, a cap is provided to cover the applicator tip or nib when not in use so that accidental spilling of the stain treatment formulation can be properly contained.

In another refinement, the shell and fluid reservoir of the disclosed device have matching cross sections thereby providing a coaxially aligned dual-compartment structure (the fluid reservoir containing the stain treatment formulation and the shell containing the absorbent member) that is ergonomical and easy to hold and use. Alternatively, the shell and the fluid reservoir are connected or attached together in a side-by-side configuration.

The shell terminates at an open end through which the absorbent member emerges to absorb, wick or lift the treated stain and excess formulation from the fabric or clothing thereby reducing the drying time for the resulting wet spot and providing improved stain removal performance.

In order to dispense the absorbent pads through the open end, the shell comprises an elongated axial slot that accommodates a slider for advancing the absorbent pads out of the open end of the shell. In a refinement, the slider includes a rear shelf disposed within the shell and perpendicular to the axial slot of the shell for pushing the absorbent pads towards the open end of the shell.

The slider may further include a wall perpendicularly connected to the rear shelf and extending from the rear shelf inside the shell and towards the open end of the shell. The wall is connected to a grip, such as a finger or thumb grip, that extends out of the shell through the axial slot, where the grip can be accessed by a finger of a consumer. In a refinement, the rear shelf is disposed between two parallel walls to form a U-shaped gripping member for gripping the absorbent member.

The wall of the slider and the axial slot in the shell may combine to form a ball/detent or ratchet mechanism for advancing the slider in fixed increments, or in increments suitable to dispense or discard the stack of pads through the open end of the shell one at a time.

In one embodiment, the shell further includes a plurality of spaced-apart cross-slots each intersecting the axial slot of the shell. The wall of the slider includes one or more outwardly protruding members or abutments which are received in one of the cross-slots and advance to an adjacent cross-slot with the slider. Such advancement is preferably accompanied with a clicking vibration or clicking sound thereby informing the user that the slider has been advanced to dispense or eject one of the absorbent pads. Although the mechanism may be designed in various degrees of sophistication by those of ordinary skill in the art, a straightforward ball/detent mechanism is preferable for simplicity of design and manufacturing purposes.

Instead of the dispensing mechanism discussed above, the absorbent member itself may comprise a built-in slider mechanism to enable the user to advance the absorbent member through the shell. The absorbent member may also be simply ejected from the end of the shell or from a sidewall of the shell when they become soiled by alternative ejection mechanisms other than the slot-slider mechanism described above. Such alternative ejection mechanisms are well known in the art and should not be considered as limiting the scope of this disclosure. Alternatively, the absorbent member may be frictionally fit within the shell and pulled out when needed. In such case, no ejection mechanism is needed.

The stack of absorbent pads may be provided in a perforated form so that a used pad is simply torn off and discarded. The absorbent pad preferably comprises matted fibers or fibers having a random or non-discernible orientation. Other materials and textures suitable for absorbing stains and liquid would be apparent to those of ordinary skill in the art and should be considered within the scope of this disclosure.

Instead of the stacked absorbent pads discussed above, the absorbent member may also be a plurality of absorbent pads provided in the form of a rotating loop or wheel disposed within the shell. When such an absorbent member is used, the shell preferably includes a dial that is engaged with the loop or wheel so that each absorbent pad may be rotationally dispensed through the open end of the shell by rotation of the dial. The absorbent pads may each be separately attached to the circumference of a center ring or they may be linked together to form a gear-shaped, one-piece absorbent member.

In another embodiment, a dual-reservoir device may be provided that includes two different stain treatment formulations, one for everyday stains and one for tough stains such as ink and grease. Such a dual-reservoir device may be provided with or without an absorbent pad dispenser. In an embodiment, the dual-reservoir device may comprise a pair of elongated housings, each defining a reservoir therein. Preferably, the housings are detachably connected together in a side-by-side configuration. The reservoirs are in communication with one or more applicator tips discussed above.

The stain treatment formulation according to this disclosure may comprise water, an organic solvent, at least one anionic surfactant, at least one nonionic surfactant, and optional adjuvants such as chelating agents, preservatives, pH adjusting agents, etc.

The organic solvent may comprise a low molecular weight monohydric alcohol, such as ethanol. Preferably, the alcohol is present at a concentration of less than about 7.5 wt %. Alternatively, the organic solvent may comprise a hydrocarbon solvent suitable for cleaning purposes, such as D-limonene. Preferably, the hydrocarbon solvent is included in the formulation at a concentration of 0.1-0.5 wt %.

The anionic surfactant may be selected from the group consisting of sodium lauryl sulfate, isopropyl amine sulfonate, sodium capryl sulfonate and mixtures thereof. Suitable anionic surfactants according to this disclosure may also be selected from the group consisting of alkyl sulfates, alkyl ethoxy sulfates (AES) such as NaAES and $NH_4$AES, amine oxides, and mixtures thereof. Other anionic surfactants that may be included in the stain treatment formulation would be apparent to one of ordinary skill in the art and should be considered within the scope of this disclosure.

The nonionic surfactant according to this disclosure may comprise an alcohol ethoxylate, such as an O—X—O alcohol ethoxylate or a linear ethoxylated $C_{12-15}$ alcohol. In a refinement, the nonionic surfactant comprises a combination of O—X—O alcohol ethoxylate and a linear ethoxylated $C_{12-15}$ alcohol. Preferably, the concentration of nonionic surfactant is below 2 wt % in order to minimize the formation of residue on the fabric or article of clothing. The nonionic surfactants preferably have an HLB (hydrophilic-lipophilic balance) value in the range of 9-17.

Optionally, the disclosed stain treatment formulation includes one or more adjuvants such as chelating agents or pH adjusting agents. In a preferred embodiment, the disclosed formulation comprises citric acid that functions both as a chelating agent and an acidifier.

One preferred formulation comprises from about 85 to about 98 wt % water, from about 0 to about 7.5 wt % ethanol, from about 0 to about 2 wt % sodium lauryl sulfonate, from about 0 to about 0.20 wt % isopropyl amine sulfonate, from about 0 to about 0.20 wt % $C_{12}$-$C_{15}$ linear ethoxylated alcohol, from about 0 to about 0.20 wt % sodium capryl sulfonate, from about 0 to about 1 wt % O—X—O alcohol ethoxylate, at least one preservative, and from about 0 to about 0.8 wt % citric acid solution (50%).

The disclosed duel-reservoir applicator preferably contains two different aqueous formulations: a first formulation for everyday stains and a second formulation for tough stains such as ink or grease. The first formulation may comprise a nonionic surfactant, an anionic surfactant, an organic solvent, a chelating agent and optional ingredients such as a preservative and fragrance. The second formulation, on the other hand, may comprise a nonionic surfactant, an anionic surfactant, one or more organic solvents, a chelating agent, a bleaching agent (preferably hydrogen peroxide) and optional ingredients such as a preservative and fragrance. It is to be understood that other formulations suitable for treating everyday stains or tough stains would be apparent to those of ordinary skill in the art and should be considered within the scope of this disclosure.

Methods for treating a stain on articles of clothing while the clothing is being worn are also disclosed. Such methods comprise delivering the stain treatment formulation to the stained clothing through one of the disclosed devices and using the absorbent member of the device to at least partially lift or remove the stain and absorb or wick excess formulation from the clothing thereby reducing the dry time of a resulting wet spot.

Other advantages and features of the disclosed device and formulation, and the method of use thereof to treat stained fabric will be described in greater detail below. Although only a limited number of embodiments are disclosed herein, different variations will be apparent to those of ordinary skill in the art and should be considered within the scope of this disclosure.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 1 is a front plan view of an instant stain-removing device equipped with an absorbent member in accordance with this disclosure;

FIG. 2 is a side plan view of the device shown in FIG. 1;

FIG. 3 is a bottom plan view of the device shown in FIGS. 1 and 2;

FIG. 4 is a perspective view of five alternative reservoir/shell cross-sections illustrating alternative cross-sections for the device shown in FIGS. 1-3 and elsewhere in this disclosure;

FIG. 25A illustrates a method for forming a fluid reservoir and a shell from a unitary molded structure;

FIG. 25B illustrates another method for forming a fluid reservoir and a shell from two separately molded structures that are fused or attached together;

FIG. 26 is a partial illustration of a stain removal device with a wheel-type absorbent member;

FIG. 27 illustrates yet another stain removal device made in accordance with this disclosure, particularly illustrating an elliptical shell, a wheel-type absorbent member and a multiple conduit applicator tip;

FIG. 28 illustrates an alternative absorbent pad ejection mechanism, particularly illustrating a side ejection mechanism made in accordance with this disclosure;

Figure 5:
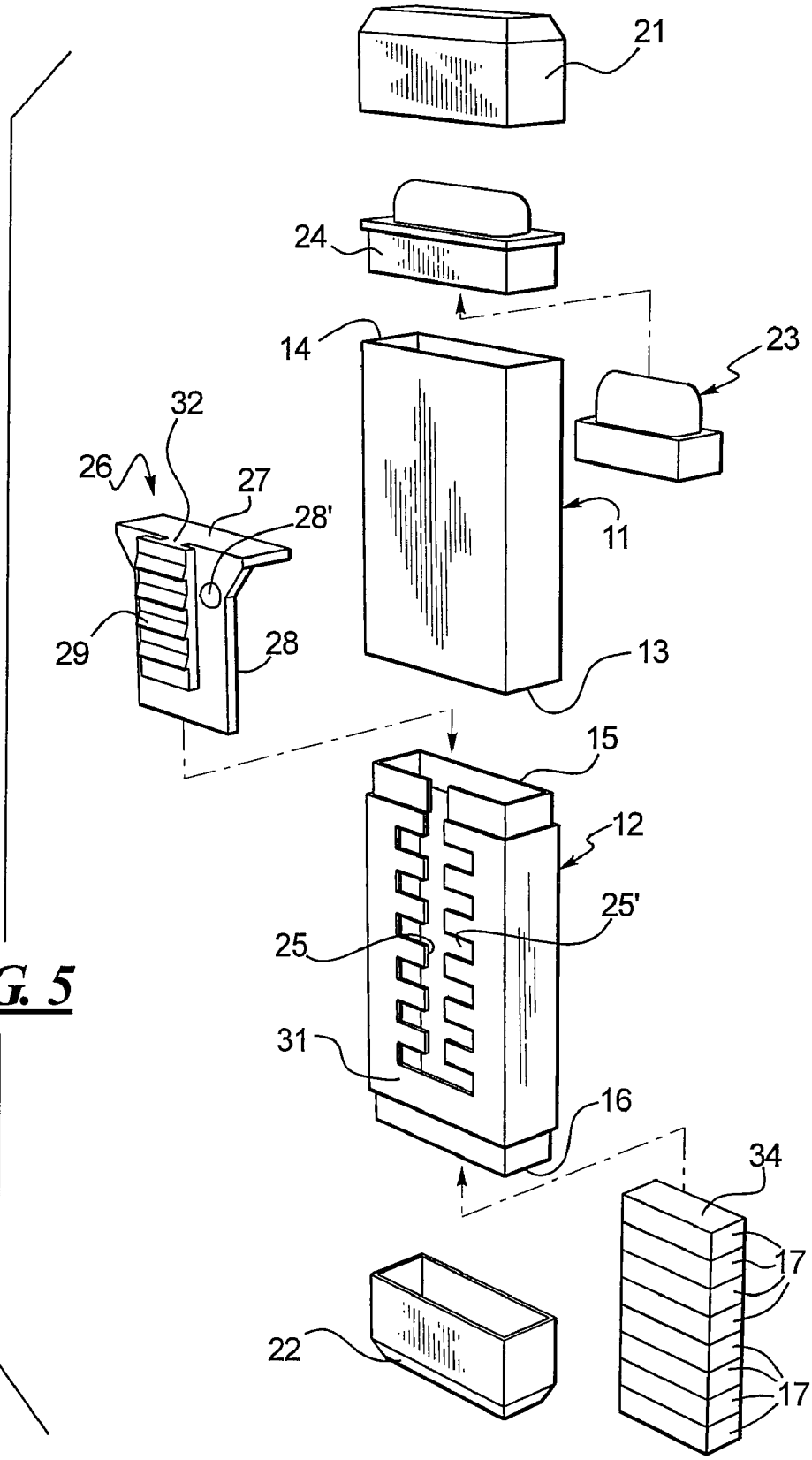
FIG. 5 is an exploded view of the device shown in FIGS. 1-3.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

An embodiment of the disclosed applicator or device for dispensing a stain treatment formulation to a fabric or article of clothing is illustrated in FIGS. 1-3. The device 10 includes a reservoir 11 connected to a shell 12, and an absorbent member 17 disposed in the shell 12. The reservoir 11 includes a proximal end 13, a distal end 14 with a hollow interior that houses the stain treatment formulation. An applicator tip 23 is provided at the distal end 14 of the reservoir 11 for dispensing the formulation to the fabric or clothing.

The proximal end 13 of the reservoir 11 is connected to the distal end 15 of the shell 12. The shell 12 terminates at a proximal open end 16 through which the absorbent member 17 (shown in phantom) emerges as shown in FIGS. 1-2. As illustrated in FIG. 1, the absorbent member 17 may be a stack of detachably connected absorbent pads, all shown in phantom at 17.

The device 10 also preferably includes end caps shown at 21, 22 in FIGS. 1-2. FIG. 3 is a bottom view of the device 10, particularly illustrating the end cap 22. The shape of the end caps and the cross-section of the reservoir 11 and shell 12 may vary, as illustrated in FIG. 4 at 11*a*-11*e*, for aesthetic or ergonomic purposes. More specifically, if the reservoir 11 needs to be squeezed to dispense the stain treatment formulation through the applicator tip 23, the reservoir 11 should be designed so that a user with weaker or arthritic hands can easily apply pressure to the device 10. The structural integrity of the reservoir 11 will depend upon the particular mechanism used to control the flow of fluid from the reservoir 11 through the applicator tip 23.

After the stain treatment formulation is delivered to the stained fabric through the applicator tip 23, the device is reversed and a distal absorbent pad 17' that emerges from the end opening 16 of the shell 12 is engaged with the treated stain thereby removing the stain and excess formulation from the fabric. When the distal pad 17' is used repeatedly or becomes soiled, the user can break the distal pad 17' off of the stack of pads 17 thereby exposing a fresh pad 17 underneath. To advance the fresh pad 17 towards the open end 16, the user merely applies force in the direction of the open end 16 of the shell 12 to move a fresh pad 17 through the open and 16 and to the position shown in FIGS. 1-2.

Turning to FIG. 5, as shown in the exploded view, the applicator tip 23 can be received within a cap 24 that, in turn, is mateably received within the distal end 14 of the reservoir 11. The tip 23 may be of a restrictive flow type that is valveless, such as those used in the delivery systems of eye drop products. For example, one excellent dispense mechanism is used with eye drop products sold under the trademark ROHTO® by the Rohto Pharmaceutical Co., Ltd. of Japan (http://www.rohtoeyedrops.com/). An example of a restrictive flow applicator tip 23*c* is also shown in FIG. 1 and discussed below.

Alternatively, the applicator tip 23 may employ various types of valve mechanisms including, but not limited to, check-valves, duckbill valves, flapper valves, cross-slot diaphragm valves, etc. In the embodiment shown in FIGS. 1 and 5, the tip 23 is preferably a cross-slot diaphragm tip.

As illustrated in FIG. 5, the shell 12 of the disclosed applicator or device may include an elongated axial slot 25 that accommodates a slider 26 for advancing or ejecting the absorbent member 17 through the open end 16. The slider 26 includes a rear shelf 27 perpendicularly connected to a front wall 28. The wall 28 is connected to a finger grip shown at 29 through a rib 32.

In use, the shelf 27 and wall 28 slide axially within the shell 12 while the grip 29 extends above the axial slot 25 and rides along a front wall 31. Such sliding mechanism engages the shelf 27 with the proximal end 34 of the absorbent member 17 and pushes the absorbent member 17 towards the open end 16 of the shell 12.

As discussed above, when the absorbent member 17 is in the form of a stack of pads, it would be advantageous to allows the pads 17 to be advanced at fixed intervals. Thus, in a preferred embodiment, a plurality of cross-slots 25' is provided on the front wall 31 each of which intersects the axial slot 25. Each cross-slot 25' is spaced one pad length apart from adjacent cross-slots 25'. As the slider 26 is advanced through the axial slot 25, flexible protruding members 28' click into the next cross-slot 25' located on the front wall 31 of the shell 12. Because the cross-slots 25' are spaced one pad length apart, an old pad 17 is removed from the open end 16 thereby exposing a new pad 17 for further applications.

Figure 6:
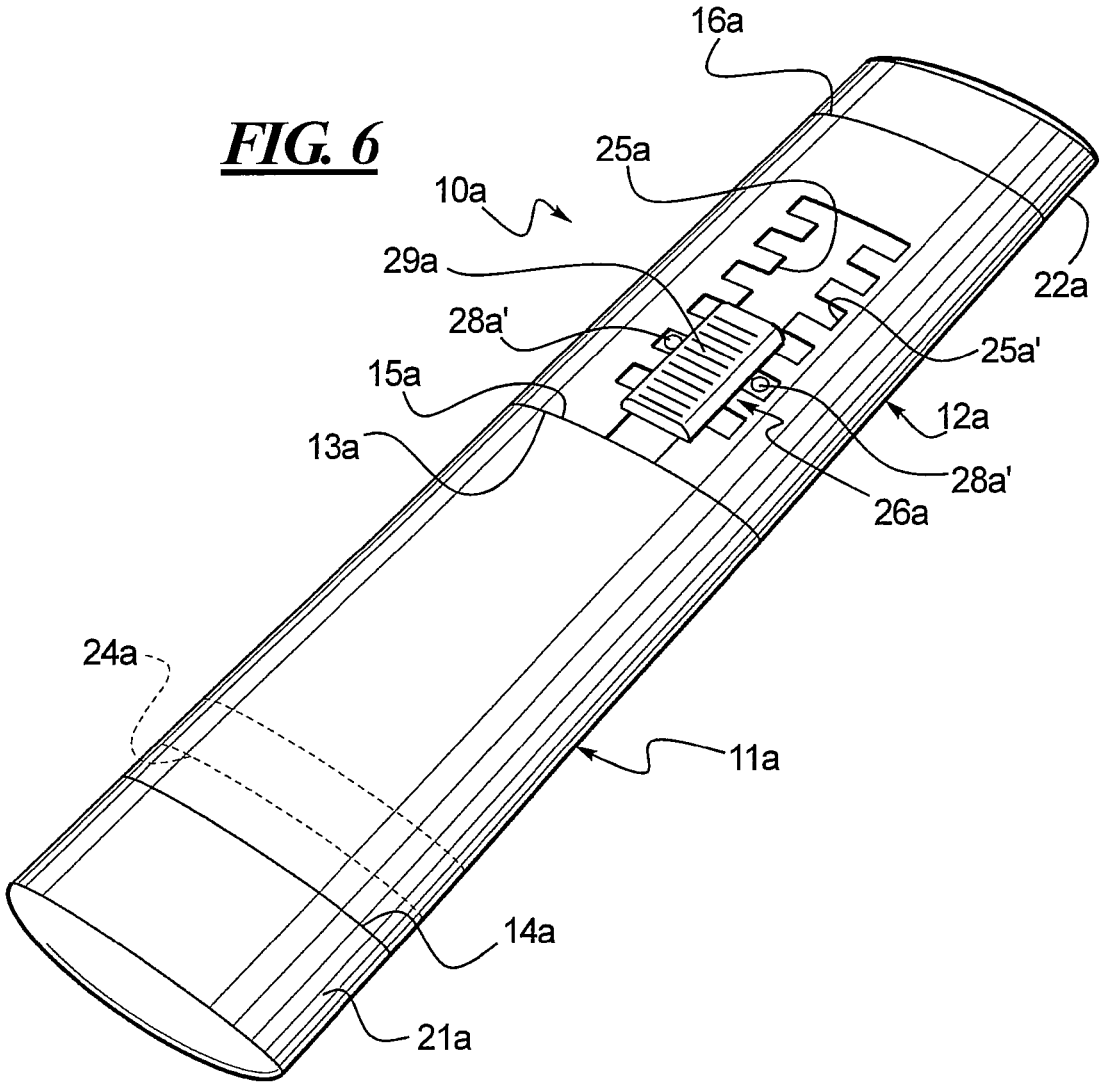
FIG. 6 is a perspective view of an alternative embodiment to the device shown in FIGS. 1-3 and 5, particularly illustrating a rounded or oval cross-section body as opposed to the rectangular cross-section body illustrated in FIGS. 1-3 and 5.
Figure 7:
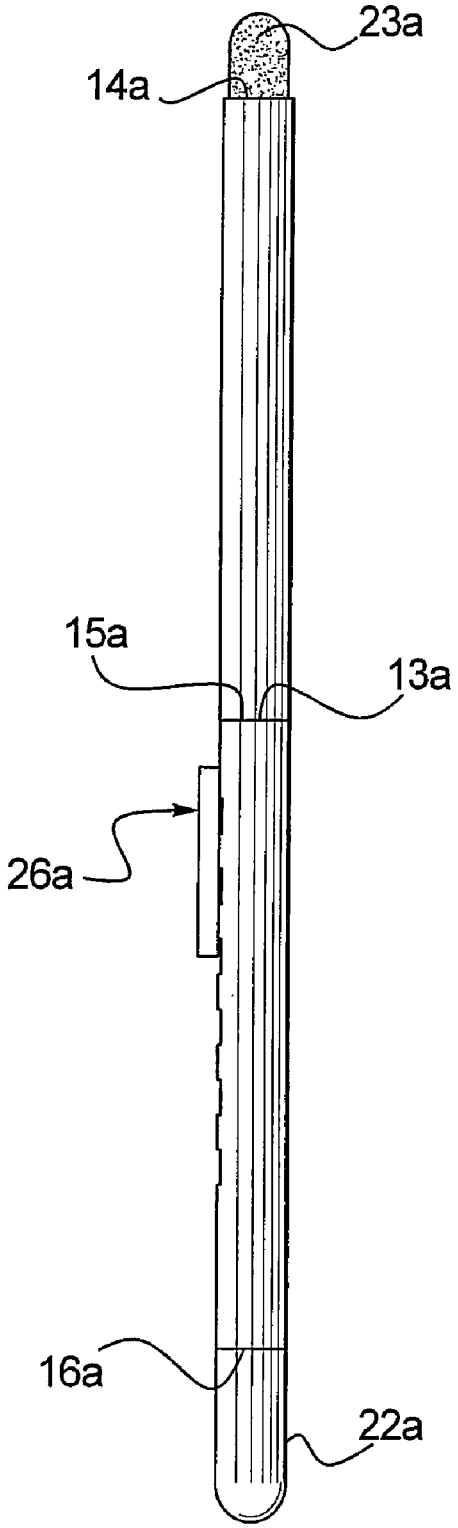
FIG. 7 is a side plan view of the device shown in FIG. 6.
Figure 8:
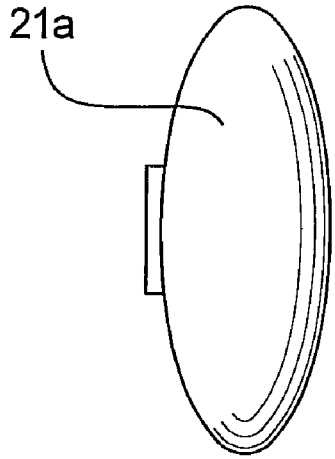
FIG. 8 is a top plan view of the device shown in FIGS. 6-7.

An alternative, but similar embodiment is shown in FIGS. 6-8. The device 10*a* includes a cap 22*a*, a shell 12*a*, a reservoir 11*a*, and a cap 21*a* as shown in FIG. 6. The shell 12*a* also includes an axial slot 25*a* through which a slider 26*a* is accommodated in the manner shown above for the device 10 illustrated in FIGS. 1-3, and 5. Instead of a rectangular cross-section for the reservoir 11*a* and shell 12*a*, the cross-sectional shape of these elements is elliptical or oval-shaped as best seen by the end view of the cap 21*a* in FIG. 8.

Figure 9:
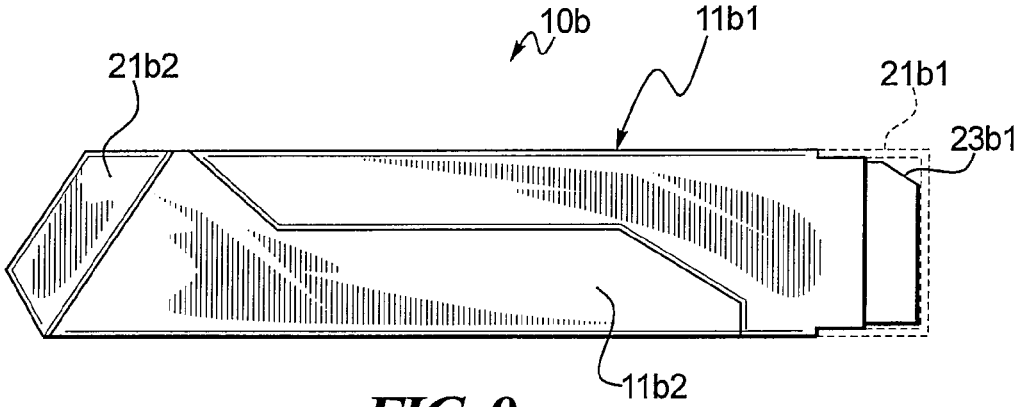
FIG. 9 is a perspective view of another alternative embodiment of the disclosed device, particularly illustrating a device for dispensing two different stain formulations using two reservoirs/applicators joined in a side-by-side fashion.
Figure 10:
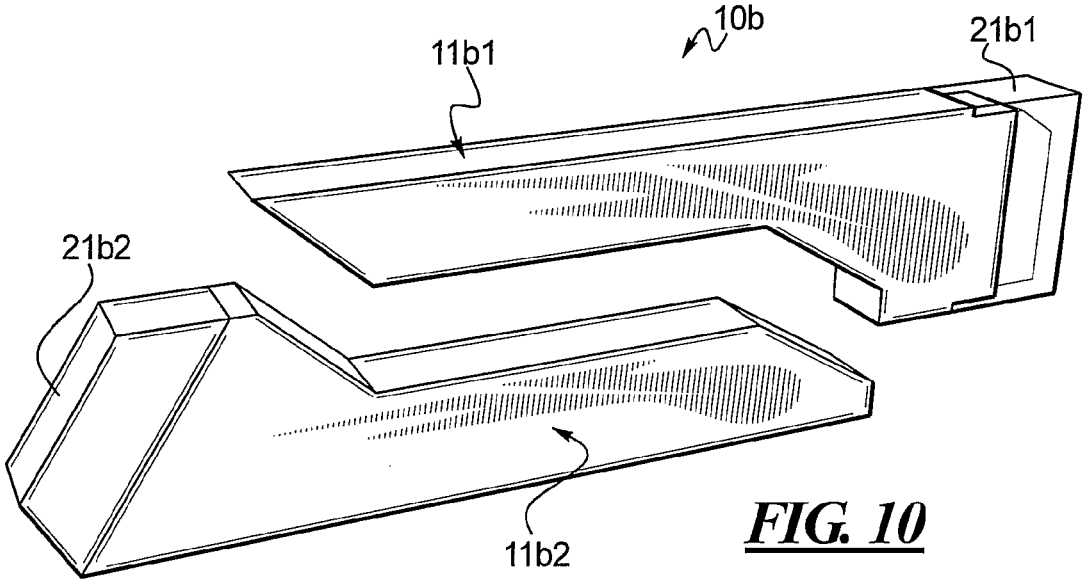
FIG. 10 is a partially exploded perspective view of the device shown in FIG. 9, particularly illustrating the separation of two reservoirs/applicators.

Another embodiment of the disclosed device is illustrated in FIGS. 9 and 10. The device 10*b* includes two fluid reservoirs 11*b*1 and 11*b*2 detachably connected together in a side-by-side configuration. Each reservoir includes a different stain treatment or stain removal formulation. In a preferred embodiment, one of the formulations includes a bleaching agent, such as hydrogen peroxide or other suitable oxidant that will not damage human skin or delicate fabrics, for treating touch stains. The other formulation is preferably free of any bleaching or oxidation agent for treating everyday stains.

The two reservoirs 11*b*1 and 11*b*2 can be detachably connected together by mechanisms well known in the art including a snapped attachment mechanism, a hook and loop-type faster system, a latch mechanism, a slot disposed on one of the reservoirs and a protruding member on the other reservoir for being received in the slot, and the like. Other detachable connection mechanisms suitable for connecting the two reservoirs will be apparent to those of ordinary skill in the art and should be considered within the scope of this disclosure.

The reservoirs 11, 11*a*, 11*b*1, 11*b*2 are semi-rigid in construction. Squeezing the sides of the reservoirs 11, 11*a*, 11*b*1, 11*b*2 causes cleaner to be dispensed through the applicator tips 23, 23*a*, 23*b*, 23*c*. The applicator tips are preferably made from a relatively soft material so as to minimize fabric damage during stain removal fluid application. The devices disclosed herein are intended to be used on the most delicate fabrics. Otherwise, foam nibs or application tips can be used instead of restrictive flow tips.

Preferably, the stain treatment formulation is delivered to the fabric or clothing by a restrictive flow tip, such as the tips 23, 23*a*, 23*b*1 and 23*c* illustrated in FIGS. 1, 5, 7, and 9-10 due to simplicity of construction. As noted above, a nib coupled with a cross-slot diaphragm valve may be used to replace the restrictive flow tip. The cross-slot diaphragm valve is in a closed position when the device is not used. When pressure is applied to the reservoir 11, however, the valve opens thereby allowing the stain treatment formulation to flow out of the nib. The diaphragm valve may be either integrated into the nib or provided as a separate piece.

In some cases, it is preferable to rub or scrape the stain or spot after the stain treatment formulation is delivered thereon. Such function may be provided by frictionally engaging the applicator tip 23 with the stained fabric or clothing. Alternatively, this function may be provided by the absorbent pads 17, which may be less rigid than the applicator tip and therefore less likely to damage delicate fabric or clothing than the applicator tip 23.

Figure 11:
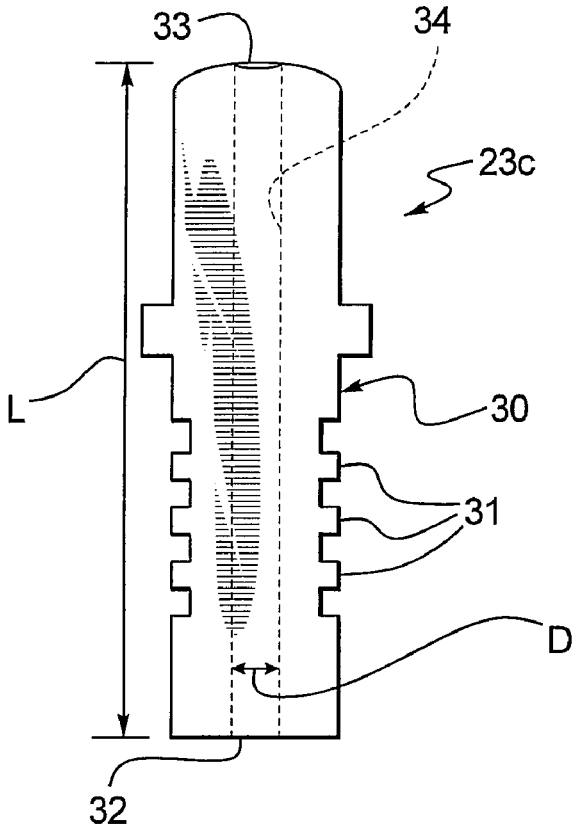
FIG. 11 is a sectional view of one applicator tip made in accordance with this disclosure.
Figure 13:
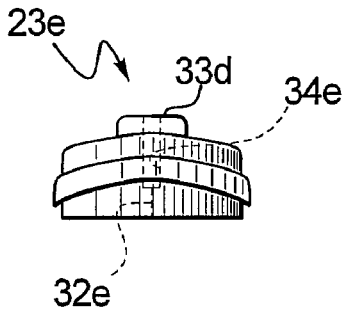
FIG. 13 is a side plan view of yet another applicator tip made in accordance with this disclosure.
Figure 12:
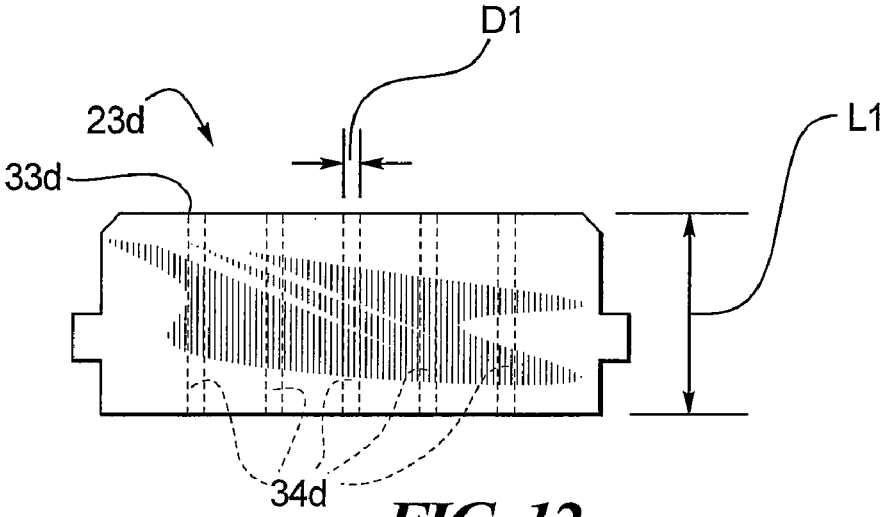
FIG. 12 is a side plan view of another applicator tip made in accordance with this disclosure.

In the embodiments utilizing restrictive flow tip for fluid delivery, a channel, conduit or tubular passageway 34, 34*d* and 34*e* as shown in FIGS. 11-13 may be provided. Preferably, the lengths of the channels (or the length of the "land") range from about 0.020 to about 0.25 inches. The inner diameters of the conduits 34, 34*d*, and 34*e* preferably range from about 0.010 to about 0.060 inches. It is to be understood, however, that the suitable shape and dimension of the conduit will depend upon the physical characteristics of the stain removal fluid and would be apparent to those of ordinary skill in the art. For example, the ranges disclosed above are suitable for stain treatment formulations having viscosities very similar to that of water. When thicker formulations are uses in the disclosed device, conduits with larger inner diameters and/or shorter land lengths may be preferred.

In particular, as shown in FIG. 11, the tip 23*c* includes a body 30 with various flanges or ribs shown at 31 for securing the tip 23*c* within an applicator or nib cap, such as that shown at 24 in FIG. 5. The tip 23*c* of FIG. 11 includes a narrower inlet opening 32 and a wider outlet opening 33 with a conduit 34 extending therebetween. FIG. 12, on the other hand, illustrates an applicator tip 23*d* that includes five restrictive conduits or passageways, all shown at 34*d*, while FIG. 13 illustrates another applicator tip 23*e* with a single conduit 34*e* that includes a narrow inlet opening 32*e* and a wider outlet opening 33*d*, similar to the tip 23*c* shown in FIG. 11.

Figure 14:
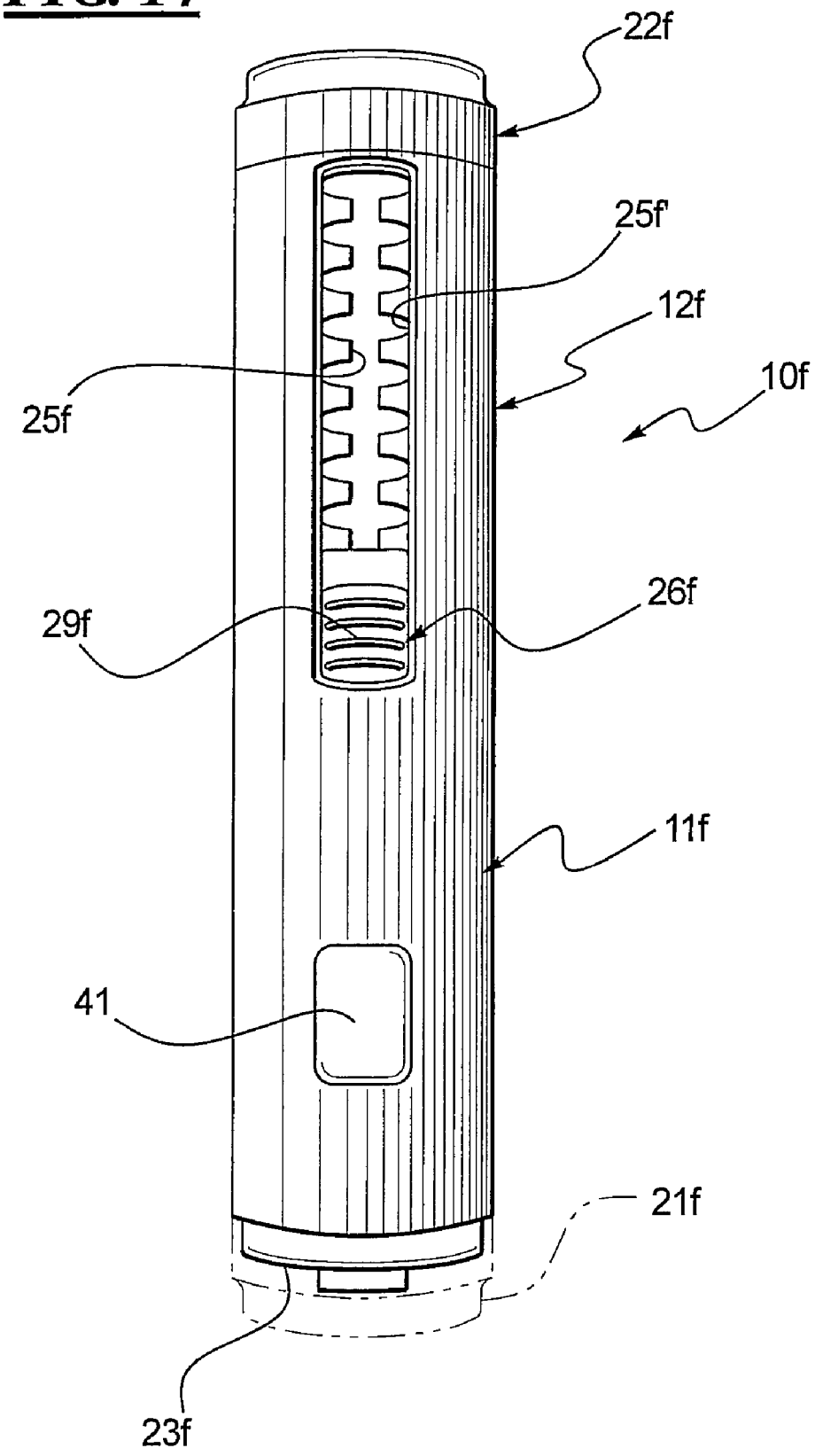
FIG. 14 is a plan view of another stain removal device made in accordance with this disclosure, particularly illustrating a reservoir with a pump mechanism and a single conduit applicator tip.
Figure 15:
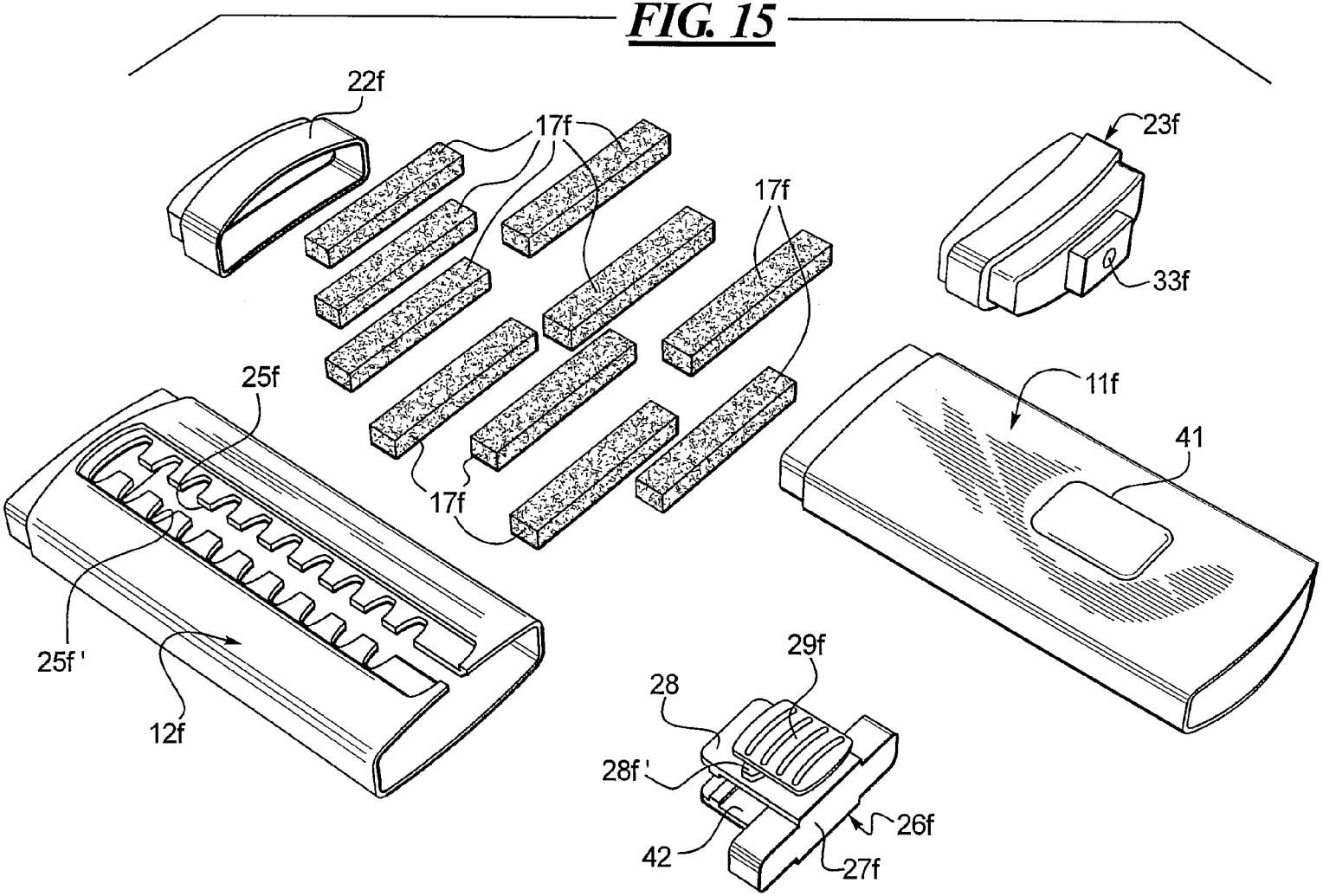
FIG. 15 is an exploded view of the stain removal device shown in FIG. 14.

FIGS. 14-15 illustrates a stain removal device 10*f* similar to the devices 10 and 10*a* discussed above in connection with FIGS. 1-3, 5, and 6-8 and therefore the equivalent parts will be identified using the same reference numerals but with the suffix "f". The applicator tip 23*f* is a single conduit tip similar to that shown in FIG. 13. The reservoir 11*f* of the device 10*f* includes a built-in pump element 41 to facilitate the delivery of the stain treatment formulation. Hence, the formulation contained in the device 10*f* can be delivered without squeeze the reservoir body 11*f*, as required by the devices 10 and 10*a*. FIG. 15 further illustrates a dual-wall slider 26*f* that includes a rear shelf 27*f* disposed between a front wall 28*f* and a rear wall 42 to form a U-shaped member for easier and more secure gripping of the absorbent member 17*f*.

Figure 16:
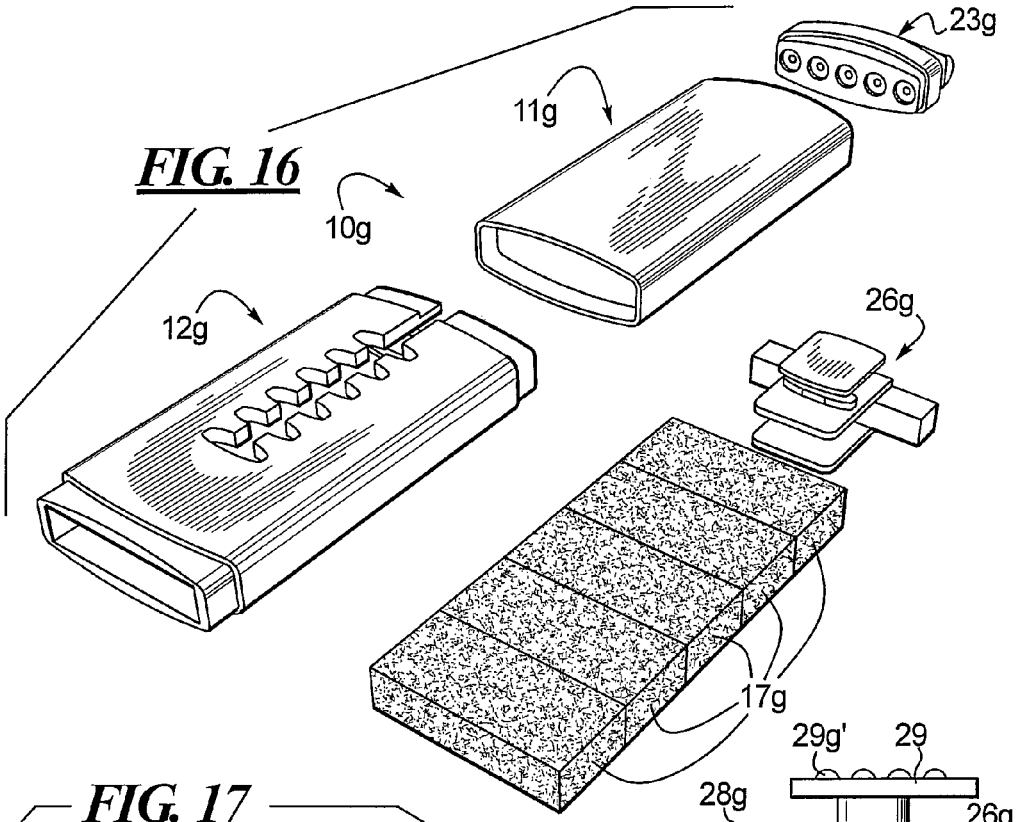
FIG. 16 is an exploded perspective view of yet another stain removal device made in accordance with this disclosure, and particularly illustrating an applicator tip with five restrictive flow conduits, arranged in a side-by-side parallel configuration.
Figure 17:
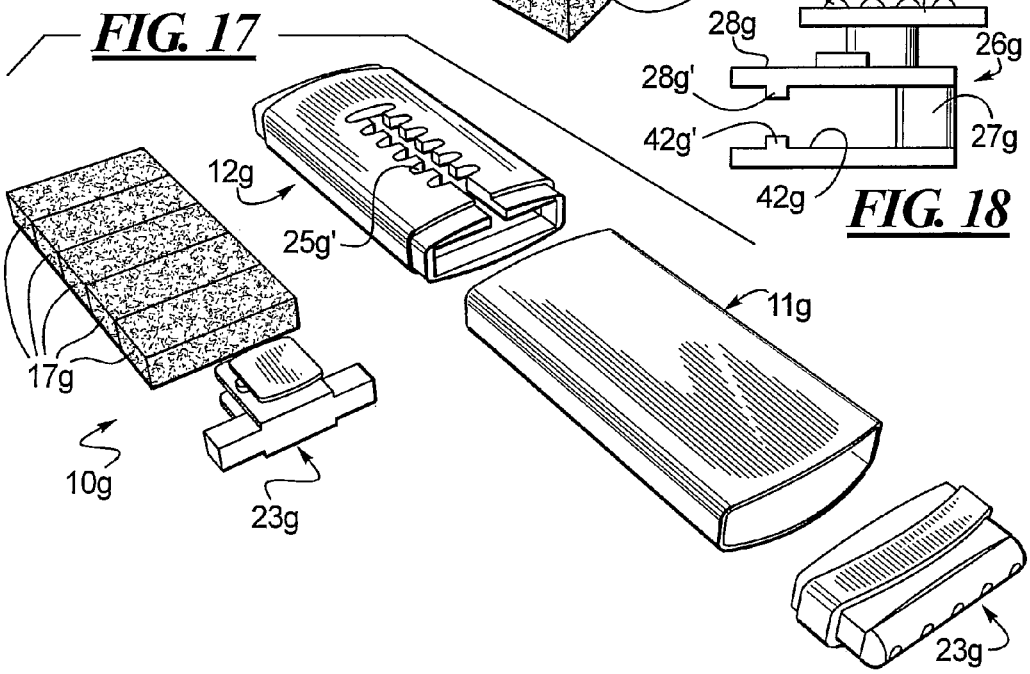
FIG. 17 is another exploded perspective view of the stain removal device shown in FIG. 16.
Figure 18:
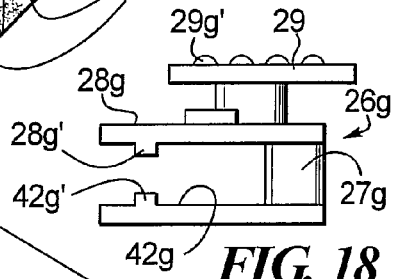
FIG. 18 is a side view of the slider mechanism shown in FIGS. 14-17.

Turning to FIGS. 16-18, which illustrate another embodiment of the disclosed device 10*g*. The device 10*g* includes a five-conduit applicator tip 23*g* analogous to that shown in FIG. 12. The side view of the slider mechanism 23*g* shown in FIG. 18 illustrates a plurality of upwardly extending protrusions 29*g*' disposed on the thumb grip 29*g* for better gripping, as well as two inwardly extending protrusions 28*g*' and 42*g*' disposed on the front wall 28*g* and rear wall 42*g* respectively for engaging the cross-slots 25*g*'.

Figure 19:
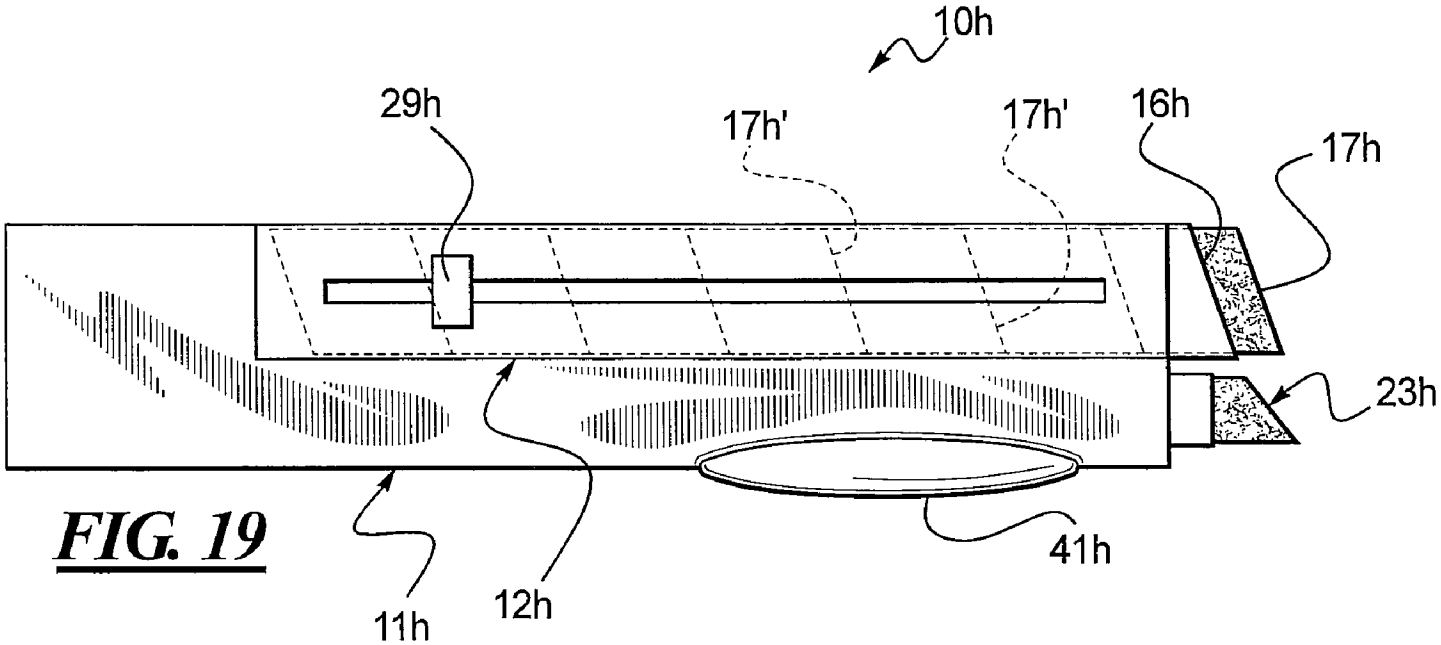
FIG. 19 is a plan view of yet another stain removal device made in accordance with this disclosure, particularly illustrating the reservoir an applicator tip arranged in a side-by-side configuration with the absorbent pad dispenser.
Figure 20:
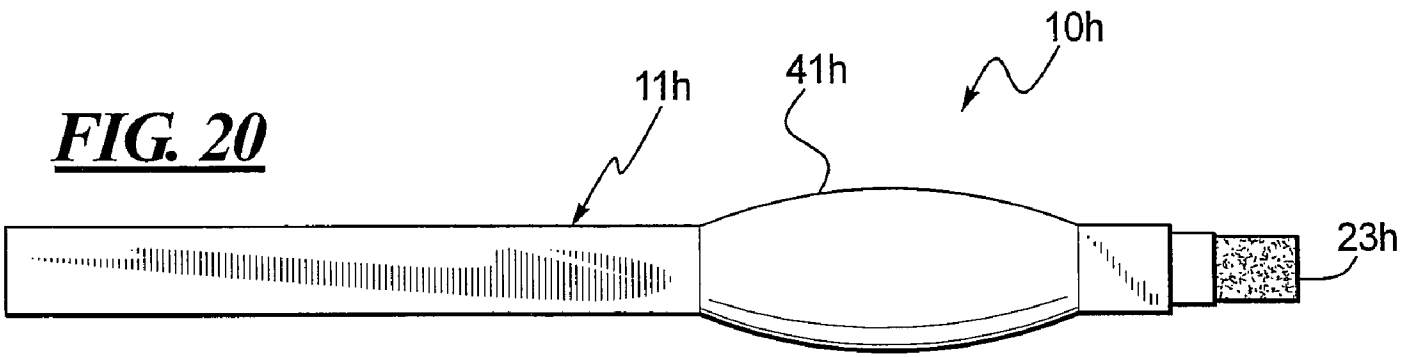
FIG. 20 is a side view of the stain removal device shown in FIG. 19, particularly illustrating the squeeze pump mechanism.

Instead of the axially aligned reservoir 11 and shell 12 discussed above, an alternative side-by-side configuration is shown in FIGS. 19-20. The device 10*h* includes a reservoir 11*h* that is L-shaped and an absorbent pad dispenser shell 12*h* arranged in a side-by-side configuration with the reservoir 11*h*. In a preferred embodiment, the distal end 16*h* of the shell 12*h* is slanted to facilitate the engagement of the absorbent pad 17*h* with the fabric. A pump mechanism is shown at 41*h* which is integrated to the reservoir 11*h*.

Figure 22:
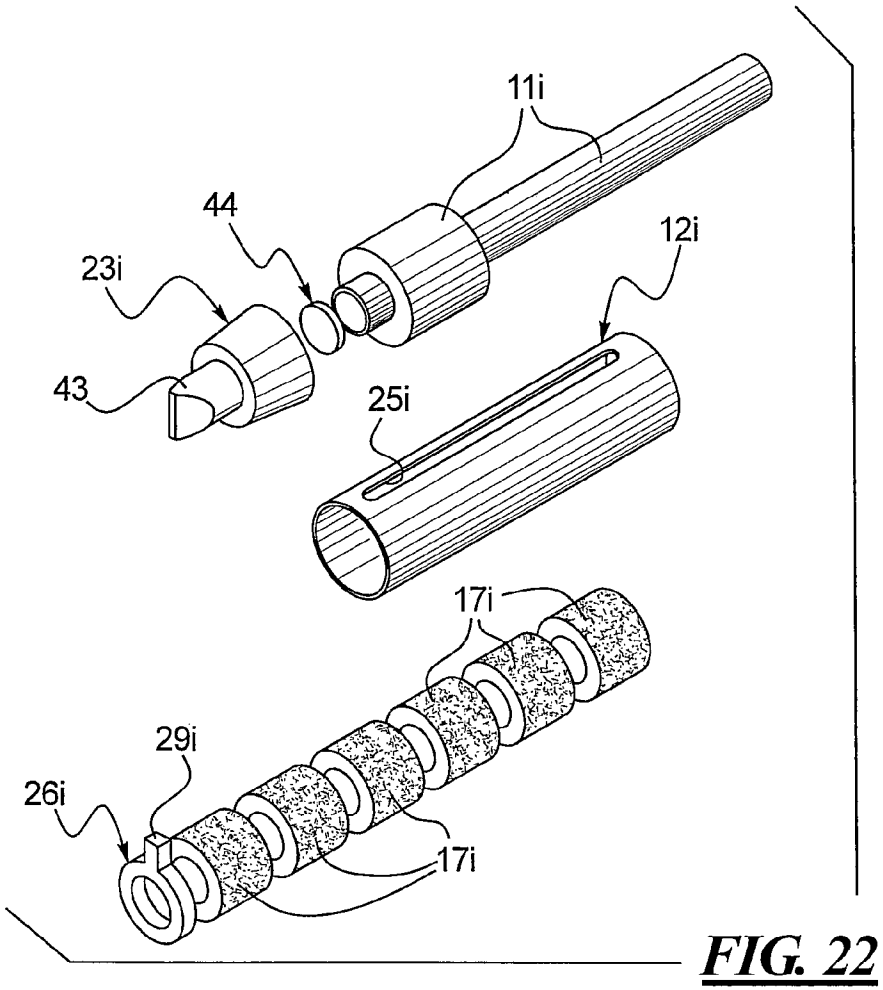
FIG. 22 is an exploded view of the stain removal device shown in FIG. 21, particularly illustrating doughnut-shaped absorbent pads.
Figure 21:
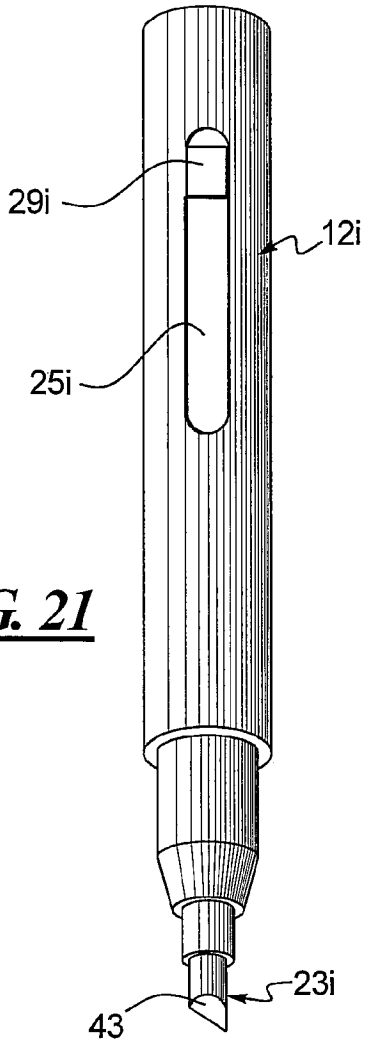
FIG. 21 is a plan view of yet another stain removal device made in accordance with this disclosure.

In addition to the aforementioned axially aligned and side-by-side configurations, the reservoir 11 and shell 12 can also adopt a concentric configuration as illustrated in FIGS. 21 and 22. The fluid reservoir 11*i* is disposed axially within and extending through a plurality of stacked doughnut-shaped absorbent pads 17*i*. In a preferred embodiment, the applicator tip 23*i* includes a conventional nib 43 and a star valve 44.

Figure 23:
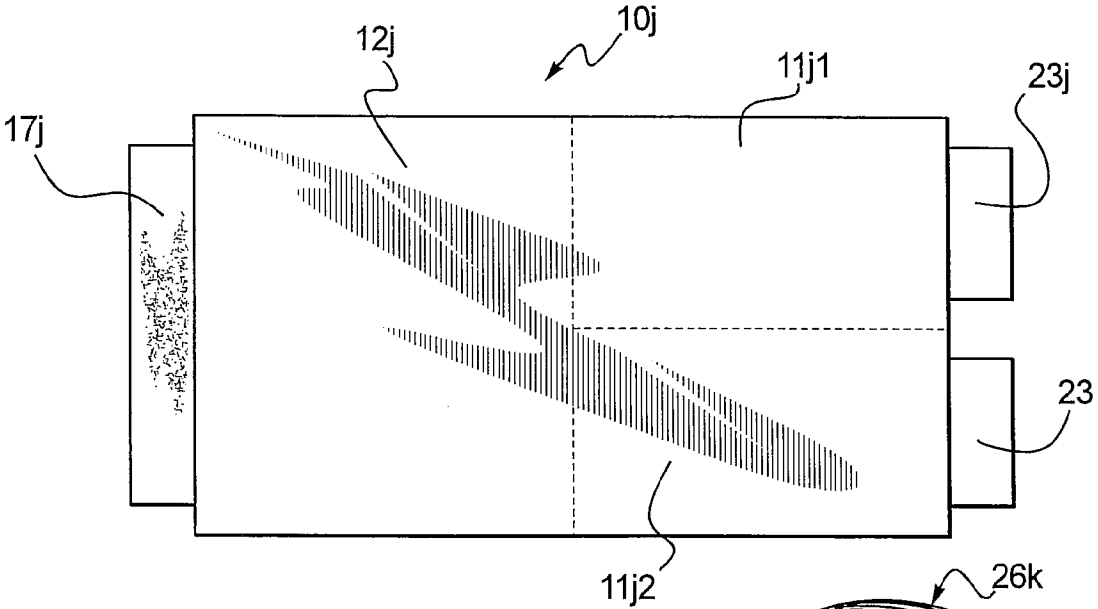
FIG. 23 is a plan view of yet another stain removal device made in accordance with this disclosure, illustrating the use of two reservoirs, two applicator tips and an absorbent member.

Another embodiment of the disclosed device includes two reservoirs and a shell housing an absorbent member, which is illustrated in FIG. 23. The device 10*j* comprises a shell 12*j* axially connected to two reservoirs 11*j*1 and 11*j*2 positioned side-by-side, each including a separate applicator tip 23*j*1, 23*j*2 for dispensing a stain treatment formulation contained therein. Preferably, one formulation is suitable for everyday stains and the other is suitable for tough stains such as ink and grease.

Figure 24:
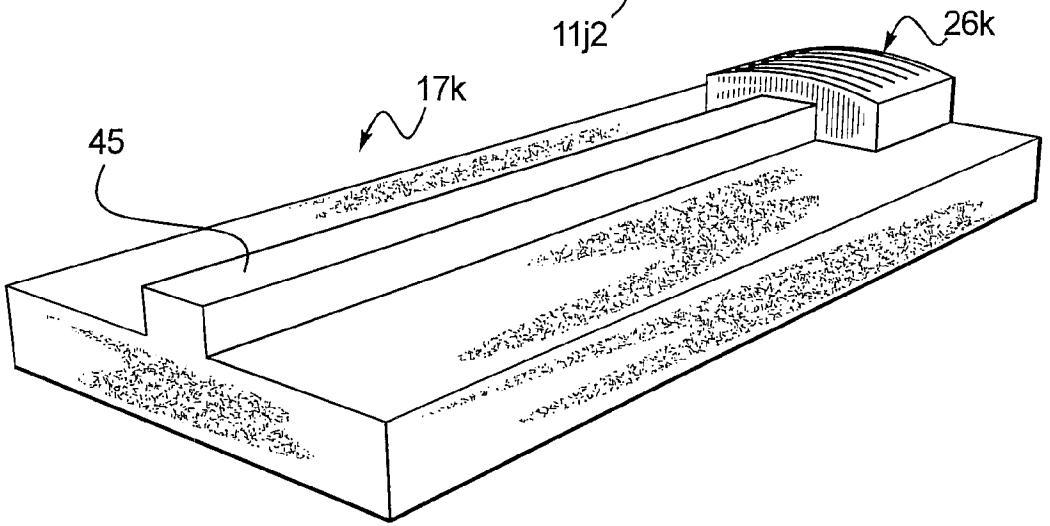
FIG. 24 is a perspective view of an absorbent member with a built-in slider mechanism.

Although the slider 26 is preferably connected to the shell 12, it may also be provided on the absorbent member 17*k* as illustrated in FIG. 24. The absorbent member 17*k* includes a built-in axial ridge 45 that is directly connected to a slider mechanism 26*k*. In use, the absorbent member is loaded into the shell 12 so that the slide mechanism 26*k* engages the slot 25 and cross-slots 25' of the shell 12.

FIGS. 25A-25B illustrate two convenient methods to connect or manufacture the axially aligned reservoirs 11 and absorbent pad shells 12. As shown in FIG. 25A, the reservoir 11*l* and the pad shell 12*l* are unitary in structure and molded contemporaneously. In FIG. 25B, the reservoir 11*m* is molded separately and coupled with the pad shell 12*m* using conventional methods such as fusing, friction fitting, gluing, or any other coupling methods that are well known in the art. Alternatively, the reservoir 11*m* and 12*m* may be connected together by a connection member such as tapes or fasteners.

FIGS. 26-27 illustrate absorbent pads 17*n*, 17*o* that are provided in a wheel or ring form which is rotatable within the shell 12*n*, 12*o*. Preferably, only one of the pads is exposed through the open end 16*n*, 16*o* for engaging the stained fabric, while the other pads are concealed within the shell 12*n*, 12*o*. When the exposed pad becomes worn or soiled after several applications, the wheel of absorbent pads is rotated within the shell 12*n*, 12*o* so that the soiled pad is concealed and an adjacent pad is exposed through the open end 16*n*, 16*o* for further applications. FIG. 27 also illustrates an applicator tip 23*o* with a multiple conduit restrictive flow design similar to that discussed above in connection with FIGS. 12, and 16-17.

Figure 29:
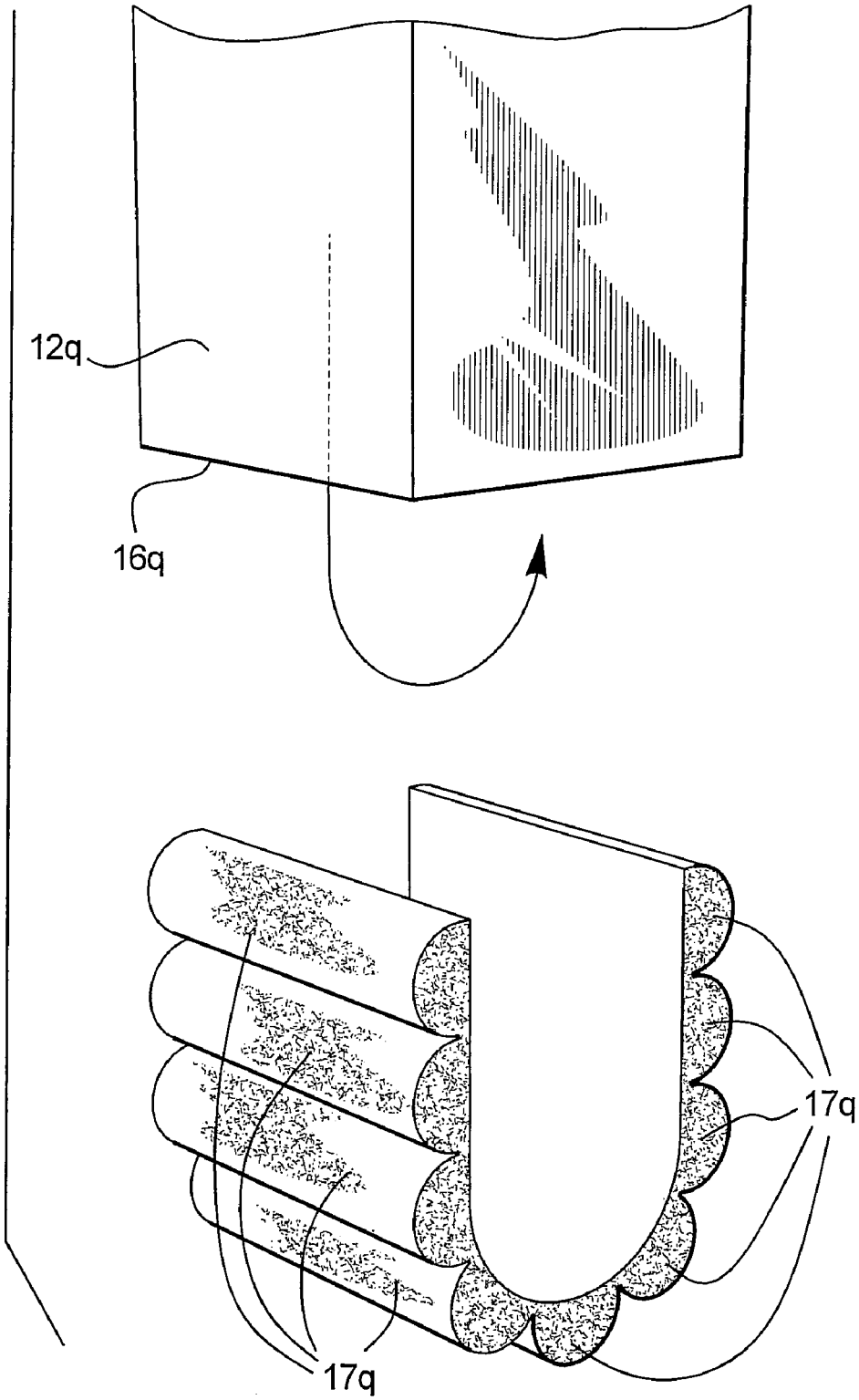
FIG. 29 is a partial illustration of yet another stain removal device made in accordance with this disclosure, particularly illustrating a rotating belt-type absorbent member dispensing mechanism.

In addition to the axial advancing and rotational dispensing mechanisms discussed above, the absorbent pads 17 may be dispensed or advanced by other mechanisms, such as those illustrated in FIGS. 28 and 29. In particular, FIG. 28 illustrates a lateral ejection mechanism in which a shell 12*p* with a shaped ejection slot shown at 51 is used for laterally ejecting (in the direction of the arrow) specially shaped pads 17*p*. After a distal pad 17*p*' is ejected, the pad 17*p* stacked on top of the ejected pad 17*p*' drops into the slot 51 for further applications. Alternatively, FIG. 29 illustrates a track or chain of pads 17*q* connected together that are rotated within the shell 12*q* with one of the pads 17*q* extending out the distal end 16*q* of the shell 12*q*.

Figure 30:
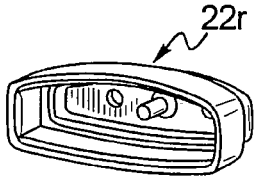
FIG. 30 is a bottom perspective view of a cover for the absorbent pad shell made in accordance with this disclosure.
Figure 31:
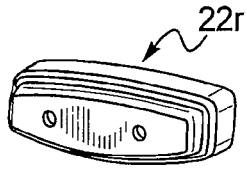
FIG. 31 is a top perspective view of the cover shown in FIG. 30.

As discussed above, an end cap may be provided at the open end of the shell 12 to cover and protect the absorbent pad 17 extending therethrough, as illustrated in FIGS. 30 and 31. Moreover, the shape and configuration of the slot 25, cross-slots 25' and slider 26, as well as the engagement mechanism thereof to advance the absorbent member 17 would be apparent to those of ordinary skill in the art and should not be considered as limiting the scope of this disclosure.

Figure 32:
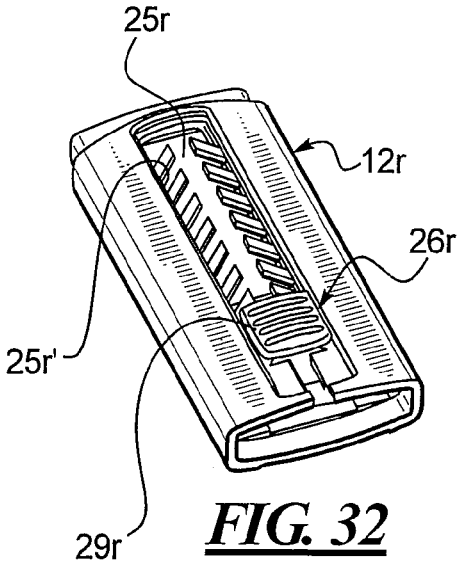
FIG. 32 is a top perspective view of yet another absorbent pad shell made in accordance with this disclosure.
Figure 33:
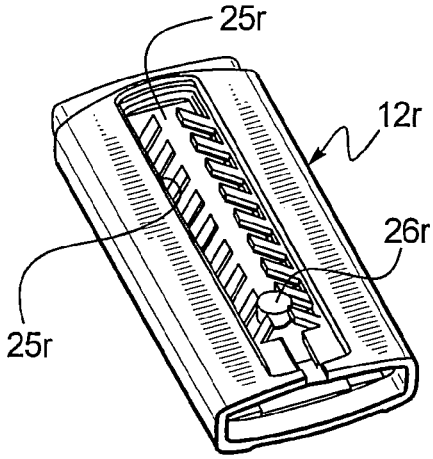
FIG. 33 is another top perspective view of the shell shown in FIG. 32 with the finger grip removed to illustrate the slider disposed below the lateral slots and along the axial slot of the shell.
Figure 34:
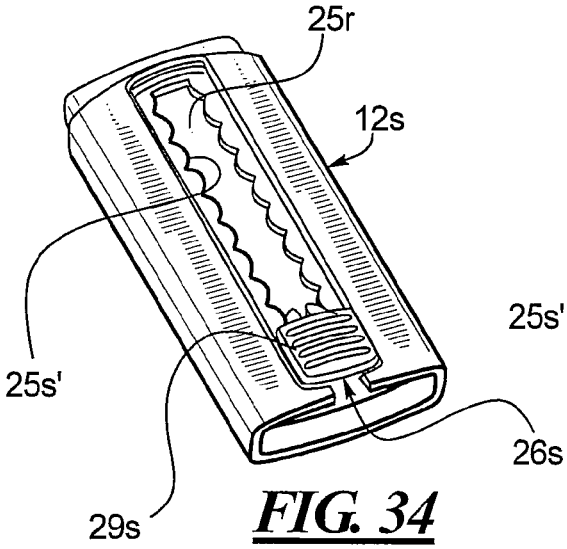
FIG. 34 is a top perspective view of yet another absorbent pad shell made in accordance with this disclosure.
Figure 35:
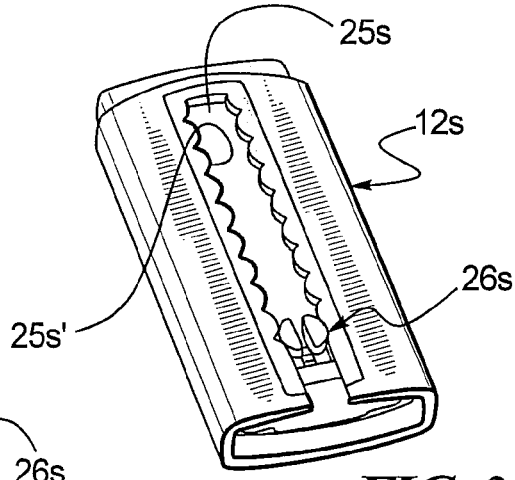
FIG. 35 is another top perspective view of the shell shown in FIG. 34 with the finger grip removed to illustrate the slider disposed below the lateral recesses and along the axial slot of the shell.

Two exemplary slot-slider engagement mechanisms are illustrated in FIGS. 32-33 and 34-35 respectively. In FIGS. 32 and 33, the shell 12*r* includes an axial slot 25*r* and a plurality of slanted intersecting or lateral slots 25*r*'. In FIGS. 34 and 35, the axial slot 25*s* includes lateral indentations, recesses or creases shown at 25*s*'. In such embodiment, no cross-slot is needed. The structure of the sliders 26*r* and 26*s* are similar to those discussed above. FIGS. 33 and 35 illustrated the sliders 26*r* and 26*s* respectively with the thumb grips 29*r* and 29*s* are moved for clarity.

The absorbent member 17 is preferably a stack of 2-10 absorbent pads made of an absorbent material suitable for absorbing excess stain treatment formulation and/or wicking up the treated stain from the fabric. The absorbent member 17 may also include a stiff scrubbing surface for frictional engagement with the stained fabric or surface to rub the formulation into the stain or loosen the stain from the fabric or surface.

For example, the absorbent material may comprise fibers fabricated from various polyesters, polyolefins, cellulose acetates and other similar materials. In one embodiment, the absorbent material may be obtained from Filtrona Richmond, Inc. of Colonial Heights, Va. (http://www.filtronafibertec-.com/BondedFiberComponents/). It is to be understood, however, that the composition of the absorbent pad is not meant to limit the scope of this disclosure, and that absorbent material other than those discussed above, both synthetic and natural, would be apparent to one of ordinary skill in the art.

An exemplary method of using the disclosed device to remove or lighten a stain from fabric is provided herein. First, a user removes the cap 21 from the applicator 23. The applicator 23 is then placed on the stain and the user applies a slight amount of squeezing pressure to the reservoir 11 either by squeezing the body of the reservoir 11 or actuating a pump element 41 integrated in the reservoir 11. The squeezing pressure either opens a valve disposed beneath a nib or forces fluid through a restrictive flow-type applicator, thereby delivering the stain treatment formulation to the stain. By controlling the time and intensity of the squeezing, the user is able to control the amount of the formulation delivered to the stain.

After the formulation is delivered to the stain, it is preferably rubbed into the stain by either the applicator tip 23 or the absorbent pads 17. Preferably, after fluid is delivered to the stain, the user reverses the device and blots/rubs the stain with the absorbent pad 17 to loosen the stain and subsequently lift and remove the stain from the fabric. The absorbent pad also functions to absorb excess stain treatment formulation from the fabric so that the drying time of the resulting wet spot on the fabric can be significantly reduced.

After several applications, the pad 17 may become worn, soiled, or discolored, in which case the user can advance the absorbent pad by sliding the slider 26 through the slot 25 (or similar pad advancing or dispensing mechanisms discussed above) to remove or conceal the used pad 17 and exposing a fresh pad 17 for further applications.

Although the disclosed device is preferably for use as an "on-the-go" stain-removing device, it may also be modified to be suitable for use as a cleaning device to pre-treat stains on fabric before the fabric is laundered. Alternatively, the disclosed device may also be modified to be suitable for applications including, but not limited to, glass cleaning, bathroom fixture cleaning, furniture care, floor care, insect control agent delivery, and fragrance delivery.

Another important aspect of this disclosure is the provision of an effective stain treatment formulation that can be used in association with the disclosed device for treating stains on fabric. As the device is preferably for removing a stain from a garment while the garment is worn by a consumer, it is preferable that the stain treatment formulation effectively loosens, dislodges or dissolves the stain and dries quickly on the garment after the stain is removed. The formulation preferably does not irritate the skin of the consumer or cause discoloration, wrinkles, residues, damages, or other undesirable appearance to the garment.

The stain treatment formulation according to this disclosure may comprise water, an organic solvent, at least one anionic surfactant, at least one nonionic surfactant, and optional adjuvants such as chelating agents, preservatives, pH adjusting agents, etc.

The organic solvent may comprise a low molecular weight monohydric alcohol, such as ethanol. Preferably, the alcohol is present an amount less than about 7.5 wt %. Alternatively, the organic solvent may comprise a hydrocarbon solvent suitable for cleaning purposes, such as D-limonene. Preferably, the hydrocarbon solvent is included in the formulation at a concentration of 0.1-0.5 wt %.

Solvent combination of water and ethanol will generally combine to reach a cumulative amount ranging from about 90 to about 98 wt %. To maintain the VOC level below the maximum allowed by certain federal and state regulations, the ethanol content should not exceed 7.5 wt %. D-limonene can also be used with water instead of or in combination with ethanol. The cumulative amount of anionic surfactants should not exceed 3 wt %. Only small amounts of anionic surfactant are necessary.

The nonionic surfactant that is used in association with the disclosed device preferably has a HLB value in the range of 9-17. Suitable nonionic surfactant according to this disclosure may include, but are not limited to: ethoxylated octylphenols; ethoxylated fatty alcohols, including the ethoxylated primary fatty alcohols; ethoxylated secondary fatty alcohols; ethoxylated nonylphenols; ethoxylated sorbitan fatty acid esters; sorbitan fatty acid esters; linear ethoxylated alcohols; O—X—O alcohol ethoxylates; and mixtures thereof.

As the disclosed stain treatment formulations are preferably for "on-the-go" application, it is preferable to keep residues at a minimum as residues would be visible on darker fabrics. Most nonionic surfactants, however, will lead to some sort of residue, especially at higher concentrations. Therefore, the nonionic surfactant included in the disclosed formulation is preferably present at a relatively low concentration.

In a preferred embodiment, the cumulative amount of nonionic surfactant, such as the LUTENSOL® and linear ethoxylated alcohol included in the exemplary formulations below, should not exceed 3 wt %. More preferably, the nonionic surfactant is present in the formulation at a concentration of lower than 2 wt %. In a most preferable embodiment, the concentration of the nonionic surfactant is about 1 wt %.

The anionic surfactants may be selected from the group consisting of sodium lauryl sulfate, isopropyl amine sulfonate, sodium capryl sulfonate and mixtures thereof. Preferably, the anionic surfactants are provided in the form of a combination of sodium lauryl sulfate, isopropyl amine sulfonate, and sodium capryl sulfonate. In one embodiment, sodium lauryl sulfate is a 28.95% aqueous solution sold under trade name Stepanol® WA-Extra PCK.

Suitable anionic surfactants may further be selected from the group consisting of alkyl sulfates, alkyl ethoxy sulfates (AES) such as NaAES and $NH_4$AES, amine oxides, and mixtures thereof. The alkyl sulfate surfactants may include branched-chain and random $C_{10}$-$C_{20}$ alkyl sulfates, and $C_{10}$-$C_{18}$ secondary (2,3) alkyl sulfates of the formula $CH_3(CH_2)_x(CHOSO_3M^+)CH_3$ and $CH_3(CH_2)_y(CHOSO_3M^+)CH_2CH_3$ where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$-$C_{16}$ alkyl, $(EO)_x$ is $(CH_2CH_2O)_x$, x is 1-10 and can include mixtures which are conventionally reported as averages, e.g., $(EO)_{2\ 5}$, $(EO)_{6\ 5}$ and the like, and Z is a cation such as sodium ammonium or magnesium (MgAES). The $C_{12}$-$C_{16}$ alkyl dimethyl amine oxide surfactants can also be used.

The optional chelating agents that may be used in the disclosed formulation may include, but are not limited to: lactic acid; salts of ethylenediamine tetraacetic acid (EDTA), such as ethylenediamine tetraacetic acid disodium salt, ethylenediamine tetraacetic acid diammonium salt, ethylenediamine tetraacetic acid trisodium salt, ethylenediamine tetraacetic acid tetrasodium salt, ethylenediamine tetraacetic acid tetrapotassium salt, ethylenediamine tetraacetic acid tetrammonium salt and the like; the salts of diethylenetriaminepentaacetic acid (DTPA), such as diethylenetriaminepentaacetic acid pentapotassium salt and the like; the salts of (N-hydroxyethyl)ethylenediaminetriacetic acid (HEDTA), such as (N-hydroxyethyl) ethylenediaminetriacetic acid trisodium salt, (N-hydroxyethyl)ethylene-diaminetriacetic acid tripotassium salt and the like; the salts of nitrilotriacetic acid (NTA), such as nitrilotriacetic acid trisodium salt, nitrilotriacetic acid tripotassium salt and the like; other chelating agents such as triethanolamine, diethanolamine, monoethanolamine, and mixtures thereof. The preferred chelating agent is citric acid because of its low cost and effectiveness.

Other optional adjuvants that may be used in the disclosed formulation include preservatives, pH adjusting agents, etc. In a preferred embodiment, the preservative is PROXEL GXL (EPA Registration No. 10182-30) manufactured by Zeneca AG Products, Inc., and is present at a concentration of about 0.01-0.5 wt %. In another preferred embodiment, the pH adjusting agent is citric acid, which also functions as the preferred chelating agent, as discussed above.

In order to effectively remove tough stains, such as ink or grease, the disclosed formulation may further include a bleaching agent, such as hydrogen peroxide, to loosen or break up the tough stains. Without being bound by any particular theory, the bleaching agent oxidizes at least a portion of the touch stains thereby facilitating the dissolving of the stains by the formulation and/or dislodging of the stains from the fabric. Other oxidation agents that are well known in the art may also be included in the formulation to improve the stain removal performance thereof.

In general, the stain treatment formulation may be a single multi-purpose formulation for treating all stains, which is suitable for use in association with a single reservoir device, or a combination of a first milder formulation for treating everyday stains and a second stronger formulation for tough stains such as ink or grease, which is preferably used in dual-reservoir devices. Embodiments of both formulations are listed in the tables/charts below.

A general multi-purpose formulation for all stains is listed below:

| Function/Description | Chemical Name/Trade Name | Amount |
|---|---|---|
| Solvent | Deionized Water | 89.32-96.82 wt % |
| Solvent | Ethyl Alcohol, Anhydrous | 0-7.5 wt % |
| Anionic Surfactant | STEPANOL ® WA-Extra PCK, Sodium Lauryl Sulfate | 0-2 wt % |
| Anionic Surfactant | Isopropylamine Sulfonate | 0-0.2 wt % |
| Anionic Surfactant | Sodium Capryl Sulfonate (38%) | 0-0.2 wt % |
| Nonionic Surfactant | LUTENSOL ® AO8, O-X-O Alcohol Ethoxylate | 0-1 wt % |
| Nonionic Surfactant | Linear ethoxylated Alcohols $C_{12-15}$ | 0-0.2 wt % |
| Preservatives | PROXEL GXL | 0.1 wt % |
| pH Adjuster | Citric Acid (50%) | 0.8 wt % |

Several embodiments of the multi-purpose formulation are list below:

EXAMPLE 1

| Function/Description | Chemical Name/Trade Name | Amount |
|---|---|---|
| Solvent | Deionized water | 96.82 to wt % |
| Solvent | Ethyl Alcohol, Anhydrous | 0 wt % |
| Anionic Surfactant | STEPANOL ® WA-Extra PCK, Sodium Lauryl Sulfate | 2 wt % |
| Anionic Surfactant | Isopropylamine Sulfonate | 0 wt % |
| Anionic Surfactant | Linear Ethoxylated Alcohols $C_{12-15}$ | 0 wt % |
| Anionic Surfactant | Sodium Capryl Sulfonate (38%) | 0 wt % |
| Nonionic surfactant | LUTENSOL ® AO8, O-X-O Alcohol Ethoxylate | 1 wt % |
| Nonionic Surfactant | Linear Ethoxylated Alcohols $C_{12-15}$ | 0 wt % |
| Preservatives | PROXEL GXL | 0.1 wt % |
| pH Adjuster | Citric Acid (50%) | 0.08 wt % |
| pH | | 6.5 |

EXAMPLE 2

| Function/Description | Chemical Name/Trade Name | Amount |
|---|---|---|
| Solvent | Deionized Water | 89.32 wt % |
| Solvent | Ethyl Alcohol, Anhydrous | 7.5 wt % |
| Anionic Surfactant | STEPANOL ® WA-Extra PCK, Sodium Lauryl Sulfate | 2 wt % |
| Anionic Surfactant | Isopropylamine Sulfonate | 0 wt % |
| Anionic Surfactant | Sodium Capryl Sulfonate (38%) | 0 wt % |
| Nonionic surfactant | LUTENSOL ® AO8, O-X-O Alcohol Ethoxylate | 1 wt % |
| Nonionic Surfactant | Linear Ethoxylated Alcohols $C_{12-15}$ | 0 wt % |
| Preservatives | PROXEL GXL | 0.1 wt % |
| pH Adjuster | Citric Acid (50%) | 0.08 wt % |
| pH | | 6.4 |

EXAMPLE 3

| Function/Description | Chemical Name/Trade Name | Amount |
|---|---|---|
| Solvent | Deionized Water | 96.54 wt % |
| Solvent | Ethyl Alcohol, Anhydrous | 0 wt % |
| Anionic Surfactant | STEPANOL ® WA-Extra PCK, Sodium Lauryl Sulfate | 0 wt % |
| Anionic Surfactant | Isopropylamine Sulfonate | 0.2 wt % |
| Anionic Surfactant | Sodium Capryl Sulfonate (38%) | 0.2 wt % |
| Nonionic Surfactant | LUTENSOL ® AO8, O-X-O Alcohol Ethoxylate | 0 wt % |
| Nonionic Surfactant | Linear Ethoxylated Alcohols $C_{12-15}$ | 0.2 wt % |
| Preservatives | PROXEL GXL | 0 wt % |
| pH Adjuster | Citric Acid (50%) | 0 wt % |
| Bleach/Oxidant | Hydrogen Peroxide (35%) | 2.86 wt % |
| pH | | 3.74 |

EXAMPLE 4

| Function/Description | Chemical Name/Trade Name | Amount |
|---|---|---|
| Solvent | Deionized Water | 99.3 wt % |
| Solvent | Ethyl Alcohol, Anhydrous | 0 wt % |
| Anionic Surfactant | STEPANOL ® WA-Extra PCK, Sodium Lauryl Sulfate | 0 wt % |
| Anionic Surfactant | Isopropylamine Sulfonate | 0.2 wt % |
| Anionic Surfactant | Sodium Capryl Sulfonate (38%) | 0.2 wt % |
| Nonionic Surfactant | LUTENSOL ® AO8, O-X-O Alcohol Ethoxylate | 0 wt % |
| Nonionic Surfactant | Linear Ethoxylated Alcohols $C_{12-15}$ | 0.2 wt % |
| Preservatives | PROXEL GXL | 0.1 wt % |
| pH Adjuster | Citric Acid (50%) | 0 wt % |

-continued

EXAMPLE 5

| Function/Description | Chemical Name/Trade Name | Amount |
|---|---|---|
| Solvent | Deionized Water | 91.8 wt % |
| Solvent | Ethyl Alcohol, anhydrous | 7.5 wt % |
| Anionic Surfactant | STEPANOL ® WA-Extra PCK, Sodium Lauryl Sulfate | 0 wt % |
| Anionic Surfactant | Isopropylamine Sulfonate | 0.2 wt % |
| Anionic Surfactant | Sodium Capryl Sulfonate (38%) | 0.2 wt % |
| Nonionic Surfactant | LUTENSOL ® AO8, O-X-O Alcohol Ethoxylate | 0 wt % |
| Nonionic Surfactant | Linear Ethoxylated Alcohols $C_{12-15}$ | 0.2 wt % |
| Preservatives | PROXEL GXL | 0.1 wt % |
| pH Adjuster | Citric Acid (50%) | 0 wt % |

EXAMPLE 6

| Function/Description | Chemical Name/Trade Name | Amount |
|---|---|---|
| Solvent | Deionized Water | 88.94 wt % |
| Solvent | Ethyl Alcohol, Anhydrous | 7.5 wt % |
| Anionic Surfactant | STEPANOL ® WA-Extra PCK, Sodium Lauryl Sulfate | 0 wt % |
| Anionic Surfactant | Isopropylamine Sulfonate | 0.2 wt % |
| Anionic Surfactant | Sodium Capryl Sulfonate (38%) | 0.2 wt % |
| Nonionic Surfactant | LUTENSOL ® AO8, O-X-O Alcohol Ethoxylate | 0 wt % |
| Nonionic Surfactant | Linear Ethoxylated | 0.2 wt % |

-continued

| Function/Description | Chemical Name/Trade Name | Amount |
|---|---|---|
| | Alcohols $C_{12-15}$ | |
| Preservatives | PROXEL GXL | 0.1 wt % |
| pH Adjuster | Citric Acid (50%) | 0 wt % |
| Bleach/Oxidant | Hydrogen Peroxide (35%) | 2.86 wt % |

An exemplary combination formulation for everyday stains and tough stains, respectively, is listed below:

AQUEOUS FORMULATION FOR EVERYDAY STAINS

| Function/Description | Amount |
|---|---|
| Nonionic Surfactant | 0.1-1 wt % |
| Anionic Surfactant | 0.1-.75 wt % |
| Solvent (D-limonene) | 0.1-0.5 wt % |
| Chelating Agents | 0.1-0.5 wt % |
| Preservative | 0-1 wt % |
| Fragrance | 0-1 wt % |

Like the single formulations disclosed above, the nonionic surfactant and anionic surfactant included in the combination formulations is preferably selected from the surfactants disclosed above. Moreover, D-limonene can be included in the formulation in addition to, or as a substitute of, the alcoholic solvent such as ethanol. As a preferred embodiment, the chelating agent is also included in the combination formulations.

AQUEOUS FORMULATION FOR BLOOD, INK AND GREASY FOODS

| Function/Description | Amount |
|---|---|
| Nonionic Surfactant | 0.1-2 wt % |
| Anionic Surfactant | 0.1-.75 wt % |
| Solvent (D-limonene) | 0.1-0.5 wt % |
| Solvent (Ethanol) | 0.1-7.5 wt % |
| Chelating Agents | 0.1-0.5 wt % |
| Bleach (Hydrogen Peroxide) | 0.1-1.5 wt % |
| Preservative | 0-1 wt % |
| Fragrance | 0-1 wt % |

While only certain embodiments have been set forth, alternatives and modifications will be apparent from the above description to those skilled in the art. These and other alternatives are considered equivalents and within the spirit and scope of this disclosure and the appended claims.

What is claimed:

1. An applicator for applying stain treatment fluid to fabric, comprising:

an applicator tip;

a fluid reservoir in communication with the applicator tip, the fluid reservoir containing a stain treatment formulation;

a shell connected to the fluid reservoir and disposed over at least a portion of the fluid reservoir with the fluid reservoir and shell being coaxially aligned, the shell terminating at an open end;

a doughnut-shaped absorbent member disposed within the shell and having the fluid reservoir disposed axially within and extending through the absorbent member; and a slider disposed within the shell and having the fluid reservoir disposed axially within and extending through the slider, and with the slider engaging the absorbent member for advancing the absorbent member towards the open end.

2. The applicator of claim 1 wherein the absorbent member comprises matted fibers.

3. The applicator of claim 1 wherein the shell comprises an elongated axial slot for accommodating a portion of the slider.

4. The applicator of claim 1 wherein the absorbent member comprises a plurality of stacked absorbent pads.

5. The applicator of claim 1 wherein the stain treatment formulation comprises:

water, an organic solvent, at least one anionic surfactant, and at least one nonionic surfactant.

6. The applicator of claim 5 wherein the organic solvent is an alcohol and is present at a concentration of less than about 7.5 wt %.

7. The applicator of claim 5 wherein the least one anionic surfactant is selected from the group consisting of sodium lauryl sulfate, isopropyl amine sulfonate, sodium capryl sulfonate and mixtures thereof.

8. The applicator of claim 5 wherein the nonionic surfactant is selected from the group consisting of an alcohol ethoxylate, a linear ethoxylated alcohol, and mixtures thereof.

9. The applicator of claim 5 wherein the formulation further comprises less than about 1.0 wt % citric acid.

10. The applicator of claim 1, wherein the applicator tip comprises:

a body comprising a proximal end and a distal end, the proximal end for being connected to a reservoir; and at least one restrictive flow passageway extending between and providing communication between the proximal and distal ends, the restrictive flow passageway comprising a narrower inlet opening and a wider outlet opening, the at least one restrictive flow passageway having an inner diameter ranging from about 0.010 to about 0.060 inches and having a length ranging from about 0.020 to about 0.25 inches.

11. The applicator of claim 10, wherein the body comprises a plurality of parallel and spaced-apart restrictive flow passageways.

12. The applicator of claim 10, wherein the body comprises from 2 to 6 parallel and spaced-apart restrictive flow passageways.

13. The applicator of claim 10 further comprising at least one flange for securing the applicator tip within an applicator cap.

14. The applicator of claim 1, wherein the applicator tip comprises a restrictive flow passageway providing communication between the reservoir and a distal outer surface of the tip, the restrictive flow passageway comprising a narrower inlet opening and a wider outlet opening.

15. The applicator of claim 1, wherein the applicator tip comprises a nib and a star valve.

16. An applicator for applying stain treatment fluid to fabric, comprising:

a fluid reservoir in communication with an applicator tip, the fluid reservoir containing a stain treatment formulation, and a shell connected to the fluid reservoir for accommodating an absorbent member, the shell terminating at an open end, the shell accommodating a slider that engages the absorbent member for advancing the member towards the open end, the applicator tip comprising a restrictive flow passageway providing communication between the reservoir and a distal outer surface of the tip, wherein the shell comprises an elongated axial slot for accommodating a portion of the slider, the slider comprising a rear shelf disposed perpendicular to the axial slot and within the shell for advancing the absorbent member towards the open end of the shell, and a wall perpendicularly connected to the rear shelf and extending from the rear shelf inside the shell and towards the open end of the shell, the wall being connected to a grip that extends from the wall and out the axial slot, wherein the shell further comprises a plurality of spaced-apart cross-slots intersecting the axial slot; and the wall further comprises at least one protuberance that is received in at least one of the cross-slots for incremental advance of the slider.

17. A method for treating a stain, spot or mark on an article of clothing while the clothing is being worn, the method comprising:

providing an applicator for applying stain treatment fluid to the clothing, the applicator comprising an applicator tip, a fluid reservoir in communication with the applicator tip, the fluid reservoir containing the stain treatment formulation, a shell connected to the fluid reservoir and disposed over at least a portion of the fluid reservoir with the fluid reservoir and shell being coaxially aligned, the shell terminating at an open end, a doughnut-shaped absorbent pad disposed within the shell and having the fluid reservoir disposed axially within and extending through the absorbent pad, and a slider disposed within the shell and having the fluid reservoir disposed axially within and extend through the slider, and with the slider engaging the absorbent pad for advancing the absorbent pad towards the open end;

engaging the clothing with the applicator tip and allowing the solution to at least partially soak the clothing on and immediately around the stain, spot or mark;

rotating the device and engaging the clothing and the solution applied to the clothing; and wicking at least some of the solution from the clothing with the absorbent pad while transferring at least some of the stain to the absorbent pad.

18. The method of claim 17 further comprising applying force to the slider to cause the absorbent pad to at least partially protrude outward from the open end of the shell.

19. The method of claim 17, wherein the applicator tip comprises a restrictive flow passageway providing communication between the reservoir and a distal outer surface of the tip, the restrictive flow passageway comprising a narrower inlet opening and a wider outlet opening.

* * * * *